US009804538B2

(12) United States Patent
Amada

(10) Patent No.: US 9,804,538 B2
(45) Date of Patent: Oct. 31, 2017

(54) IMAGE FORMING APPARATUS AND IMAGE FORMING METHOD IN CONTROLLING ELECTRONIC RESISTANCE VALUES FOR IMAGE TRANSFER

(71) Applicant: Oki Data Corporation, Tokyo (JP)

(72) Inventor: Daitetsu Amada, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/186,013

(22) Filed: Jun. 17, 2016

(65) Prior Publication Data

US 2017/0023890 A1 Jan. 26, 2017

(30) Foreign Application Priority Data

Jul. 21, 2015 (JP) ..... 2015-144044

(51) Int. Cl.
*G03G 15/16* (2006.01)
*G03G 21/20* (2006.01)

(52) U.S. Cl.
CPC ..... *G03G 15/1675* (2013.01); *G03G 15/1605* (2013.01); *G03G 21/203* (2013.01)

(58) Field of Classification Search
CPC ..... G03G 15/1665; G03G 21/203; G03G 15/1675; G03G 21/20
USPC ..... 399/66, 384, 389
See application file for complete search history.

(56) References Cited

U.S. PATENT DOCUMENTS

2003/0035671 A1* 2/2003 Estabrooks ..... B41J 11/42 399/384
2006/0222391 A1* 10/2006 Choi ..... G03G 15/1675 399/66
2011/0280598 A1* 11/2011 Campbell ..... G03G 15/1675 399/44

FOREIGN PATENT DOCUMENTS

JP 2014-066919 A 4/2014

* cited by examiner

*Primary Examiner* — Sandra Brase
(74) *Attorney, Agent, or Firm* — Muncy, Geissler, Olds & Lowe, P.C.

(57) ABSTRACT

An image forming apparatus includes an image forming part having a transfer part including a transfer member and a rotation member to face the transfer member, and the transfer part to transfer a developer with a transfer voltage to a recording medium of which a front surface is with a transfer region and a non-transfer region, in the transfer target region where the developer is to be disposed and in the non-transfer region where the developer is not to be disposed; a measuring part that measures a first electric resistance value and a second electric resistance value, the first electric resistance value being defined as in a state in which the transfer region is not present between the transfer member and the rotation member, and the second electric resistance value being defined as in another state in which the transfer region is present therebetween; and a control part that determines the transfer voltage value in the transfer part based on the first electric resistance value and the second electric resistance value.

16 Claims, 17 Drawing Sheets

| | No Recording Medium 9 | With Recording Medium 9 | |
|---|---|---|---|
| | | With Mount 9B | With Labe 9A and Mount 9B |
| Detected Voltage (Vdet) | Vdet>1.5V | 0.3<Vdet≦1.5V | Vdet≦0.3V |

| Medium Current Density Jp (μA/mm) | | Humidity (%) | | | | |
|---|---|---|---|---|---|---|
| | | ~20 | 20~40 | 40~60 | 60~80 | 80~ |
| Temp. (°C) | ~10 | 0.16 | 0.15 | 0.14 | 0.13 | 0.12 |
| | 10~20 | 0.15 | 0.14 | 0.13 | 0.12 | 0.11 |
| | 20~30 | 0.14 | 0.13 | 0.12 | 0.11 | 0.10 |
| | 30~ | 0.13 | 0.12 | 0.11 | 0.10 | 0.09 |

*Fig. 8*

| Medium Volt. Vp (kV) | | Humidity (%) | | | | |
|---|---|---|---|---|---|---|
| | | ~20 | 20~40 | 40~60 | 60~80 | 80~ |
| Temp. (°C) | ~10 | 1.20 | 1.05 | 0.90 | 0.75 | 0.60 |
| | 10~20 | 1.05 | 0.90 | 0.75 | 0.60 | 0.45 |
| | 20~30 | 0.90 | 0.75 | 0.60 | 0.45 | 0.30 |
| | 30~ | 0.75 | 0.60 | 0.45 | 0.30 | 0.15 |

IMAGE FORMING APPARATUS AND IMAGE FORMING METHOD IN CONTROLLING ELECTRONIC RESISTANCE VALUES FOR IMAGE TRANSFER

CROSS REFERENCE TO RELATED APPLICATIONS

This application claims priority under 35 USC 119 to Japanese Patent Application No. 2015-144044 filed on Jul. 21, 2015, the entire contents which are incorporated herein by reference.

TECHNICAL FIELD

The present invention relates to an image forming apparatus and an image forming method for forming images.

BACKGROUND

In some image forming apparatuses, a transfer part transfers a toner image to a recording medium. For example, Patent Document 1 discloses an image forming apparatus configured to determine a transfer voltage value based on a transfer voltage value in a state in which no recording medium is present at a transfer part.

RELATED ART

[Patent Document 1] Japanese Unexamined Patent Application Publication No. 2014-066919

In the meantime, in an image forming apparatus, it is desired that the image quality be high, and further improvements in the image quality are expected.

The present invention was made in view of the aforementioned problems, and aims to provide an image forming apparatus and an image forming method capable of improving the image quality.

SUMMARY

An image forming apparatus includes: an image forming part having a transfer part including a transfer member, and a rotation member arranged so as to face the transfer member, and the transfer part being configured to transfer a developer with a transfer voltage to a recording medium of which a front surface is composed with a transfer region and a non-transfer region arranged between the transfer member and the rotation member, in the transfer target region where the developer is to be disposed and in the non-transfer region where the developer is not to be disposed; a measuring part that measures a first electric resistance value and a second electric resistance value, the first electric resistance value being defined as a resistance value between the transfer member and the rotation member in a state in which the transfer region of the recording medium is not present between the transfer member and the rotation member, and the second electric resistance value being defined as another resistance value between the transfer member and the rotation member in another state in which the transfer region of the recording medium is present between the transfer member and the rotation member; and a control part that determines the transfer voltage value in the transfer part based on the first electric resistance value and the second electric resistance value.

An image forming method performed with a transfer part includes measuring, in the transfer part having a transfer member and a rotation member arranged so as to face the transfer member and configured to transfer a developer with a transfer voltage to a recording medium of which a surface is composed with a transfer region and a non-transfer region arranged between the transfer member and the rotation member, a first electric resistance value between the transfer member and the rotation member in a state in which the transfer region of the recording medium is not present between the transfer member and the rotation member; measuring a second electric resistance value between the transfer member and the rotation member in a state in which the transfer region of the recording medium is present between the transfer member and the rotation member; and determining the transfer voltage value in the transfer part based on the first electric resistance value and the second electric resistance value.

According to the image forming apparatus and the image forming method of the present invention, since the transfer voltage is determined based on the first electric resistance value in a state in which a transfer region of the recording medium is not present between the transfer member and the rotation member and the second electric resistance value in a state in which a transfer region of the recording medium is present between the transfer member and the rotation member, the image quality can be improved.

BRIEF DESCRIPTION OF THE DRAWINGS

FIG. 8 is a table showing one example of a voltage table shown in FIG. 5.

DETAILED DESCRIPTION OF THE EMBODIMENTS

Hereinafter, some embodiments of the present invention will be described in detail with reference to the drawings. The description will be done in the following order.

1. Embodiment 1 (an example in which a label width W is constant)
2. Embodiment 2 (an example in which a label width W is not constant)

1. Embodiment 1 [Configuration Example]

Figure 1:
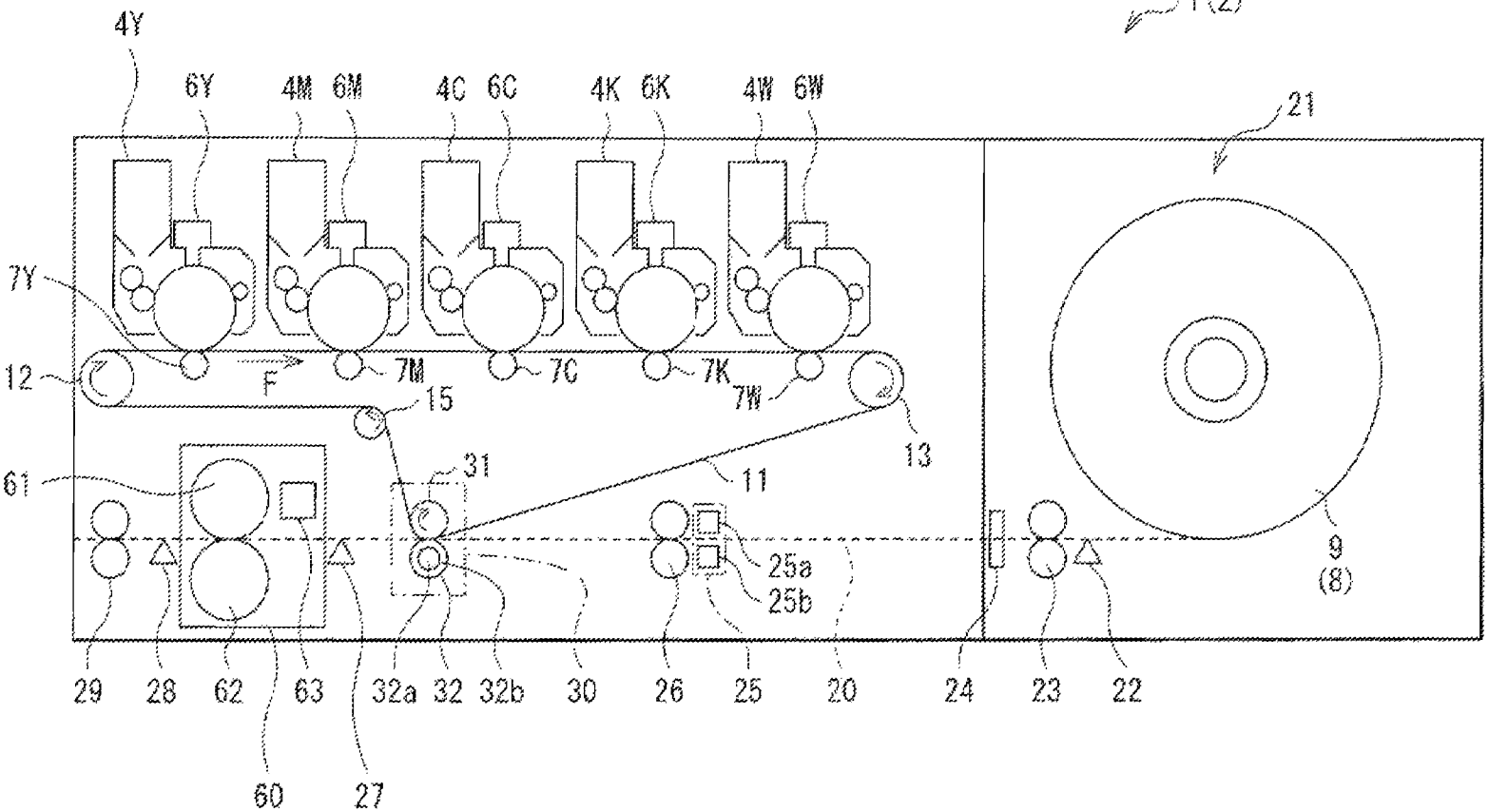
FIG. 1 is an explanatory view showing one configuration example of an image forming apparatus according to a first embodiment of the present invention.

FIG. 1 shows one configuration example of an image forming apparatus (image forming apparatus 1) according to a first embodiment of the present invention. The image forming apparatus 1, for example, functions as a printer for forming an image using an electrographic method on a recording medium made of a rolled sheet.

The image forming apparatus 1 includes five ID (Image Drum) units 4 (4Y, 4M, 4C, 4K, 4W), five exposure devices 6 (6Y, 6M, 6C, 6K, 6W), five primary transfer rollers 7 (7Y, 7M, 7C, 7K, 7W), a transfer belt 11, a drive roller 12, an idler roller 13, a secondary transfer backup roller 31, and a reverse bending roller 15.

The five ID units 4 are each configured to form a toner image. Specifically, the ID unit 4Y is configured to form a yellow (Y) toner image, the ID unit 4M is configured to form a magenta (M) toner image, the ID unit 4C is configured to form a cyan (C) toner image, the ID unit 4K is configured to form a black (K) toner image, and the ID unit 4W is configured to form a white (W) toner image. The ID units 4Y, 4M, 4C, 4K, and 4W are arranged in the carrying direction F in this order.

Figure 2:
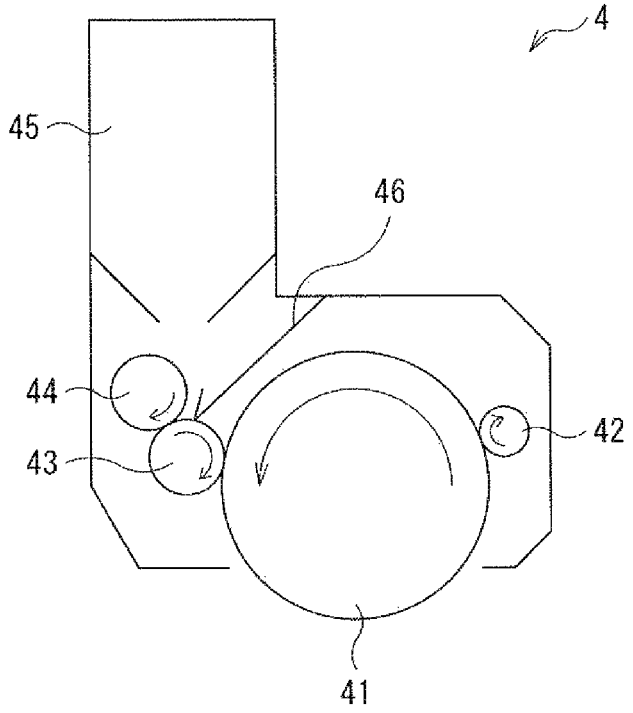
FIG. 2 is an explanatory view showing one configuration example of an ID unit shown in FIG. 1.

FIG. 2 shows one configuration example of the ID unit 4. The ID unit 4 is equipped with a photosensitive body 41, a charge roller 42, a development roller 43, a supply roller 44, a toner accommodation section 45, and a toner blade 46.

The photosensitive body 41 is a member for carrying an electrostatic latent image on the surface (surface layer portion). The photosensitive body 41 rotates counterclockwise in this example by a power transmitted from an unillustrated photosensitive body motor. The photosensitive body 41 is charged by the charge roller 42. Further, the photosensitive body 41 of the ID unit 4Y is exposed by the exposure device 6Y, the photosensitive body 41 of the ID unit 4M is exposed by the exposure device 6M, the photosensitive body 41 of the ID unit 4C is exposed by the exposure device 6C, the photosensitive body 41 of the ID unit 4K is exposed by the exposure device 6K, and the photosensitive body 41 of the ID unit 4W is exposed by the exposure device 6W. In this way, an electrostatic latent image is formed on the surface of each of the photosensitive bodies 41.

The charge roller 42 is a member for charging the surface (surface layer portion) of the photosensitive body 41 to a negative voltage, for example.

The charge roller 42 is arranged so as to be in contact with the surface (circumferential surface) of the photosensitive body 41, and rotates clockwise in this example according to the rotation of the photosensitive body 41. As will be explained later, a predetermined voltage is applied to the charge roller 42 by a high voltage power supply part 56.

The development roller 43 is a member for carrying a toner charged to a negative voltage to the surface. The development roller 43 is arranged so as to be in contact with the surface (circumferential surface) of the photosensitive body 41 and rotates clockwise in this example by a power transmitted from an unillustrated photosensitive body motor. In each of the photosensitive bodies 41, a toner image according to an electrostatic latent image is formed (developed) by the toner supplied from the development roller 43. As will be explained later, a predetermined voltage is applied to the development roller 43 by a high voltage power supply part 56.

The supply roller 44 is a member configured to charge the toner stored in the toner accommodation section 45 to a negative voltage and supply it to the development roller 43. The supply roller 44 is arranged so as to be in contact with the surface (circumferential surface) of the development roller 43 and rotates clockwise in this example by a power transmitted from an unillustrated photosensitive body motor. With this, in the ID unit 4, friction is generated between the surface of the supply roller 44 and the surface of the development roller 43 and as a result, the toner is charged by the so-called frictional charge. As will be explained later, a predetermined voltage is applied to the supply roller 44 by the high voltage power supply part 56.

The toner accommodation section 45 is configured to store a toner. Specifically, the toner accommodation section 45 in the ID unit 4Y stores a yellow (Y) toner, the toner accommodation section 45 in the ID unit 4M stores a magenta (M) toner, the toner accommodation section 45 in the ID unit 4C stores a cyan (C) toner, and the toner accommodation section 45 in the ID unit 4K stores a black (K) toner and the toner accommodation section 45 in the ID unit 4W stores a white (W) toner.

The toner blade 46 is a member arranged so as to be in contact with the surface of the development roller 43 to form a layer consisting of a toner (toner layer) on the surface of the development roller 43 and regulate (control, adjust) the thickness of the toner layer. The toner blade 46 is, for example, a plate-like elastic member (flat spring) made of stainless steel, etc., and the front edge part of the toner blade 46 is arranged so as to be in contact with the surface of the development roller 43. As will be explained later, a predetermined voltage is applied to the toner blade 46 by the high voltage power supply part 56.

The five exposure devices 6*x* (FIG. 1) are members each configured to irradiate, e.g., 600 dpi spot light on the photosensitive body 41 of each of the five ID units 4. Specifically, the exposure device 6Y is a member configured to irradiate a spot light on the photosensitive body 41 of the ID unit 4Y, the exposure device 6M is a member configured to irradiate a spot light on the photosensitive body 41 of the ID unit 4M, the exposure device 6C is a member configured to irradiate a spot light on the photosensitive body 41 of the ID unit 4C, the exposure device 6K is a member configured to irradiate a spot light on the photosensitive body 41 of the ID unit 4K, and the exposure device 6W is a member configured to irradiate a spot light on the photosensitive body 41 of the ID unit 4W. With this, these photosensitive bodies 41 are exposed by the respective exposure devices 6. As a result, an electrostatic latent image is formed on the surface of each of the photosensitive bodies 41.

The five primary transfer rollers 7 each are a member configured to electrostatically transfer a toner image formed by the respective five ID units 4 on the target transfer face of the transfer belt 11. The primary transfer roller 7Y is arranged so as to face the photosensitive body 41 of the ID unit 4Y via the transfer belt 11, the primary transfer roller 7M is arranged so as to face the photosensitive body 41 of the ID unit 4M via the transfer belt 11, the primary transfer roller 7C is arranged so as to face the photosensitive body 41 of the ID unit 4C via the transfer belt 11, the primary transfer roller 7K is arranged so as to face the photosensitive body 41 of the ID unit 4K via the transfer belt 11, and the primary transfer roller 7W is arranged so as to face the photosensitive body 41 of the ID unit 4W via the transfer belt 11. As will be explained later, a predetermined voltage is applied to each of the primary transfer rollers 7 by the high voltage power supply part 56. With this, in the image forming apparatus 1, the toner image formed by each of the ID units 4 is transferred (primary transferred) onto the target transfer face of the transfer belt 11.

The transfer belt 11 is, for example, an endless elastic belt constituted by a high-resistance semiconductive plastic film. The transfer belt 11 is extended (stretched) by the drive roller 12, the idler roller 13, the secondary transfer backup roller 31, and the reverse bending roller 15. Further, the transfer belt 11 circularly turns in the carrying direction F according to the rotation of the drive roller 12. At that time, the transfer belt 11 passes between the ID unit 4Y and the primary transfer roller 7Y, between the ID unit 4M and the primary transfer roller 7M, between the ID unit 4C and the primary transfer roller 7C, between the ID unit 4K and the primary transfer roller 7K, and between the ID unit 4W and the primary transfer roller 7W, and turns circularly.

The drive roller 12 is configured to circularly rotate the transfer belt 11. In this example, the drive roller 12 is arranged on the upstream side of the five ID units 4 in the carrying direction F and rotates clockwise in this example by a power transmitted from an unillustrated transfer belt motor. With this, the drive roller 12 is configured to circularly rotate the transfer belt 11 in the carrying direction F.

The idler roller 13 is configured to be driven to rotate clockwise in this example according to the circular rotation of the transfer belt 11. In this example, the idler roller 13 is arranged on the downstream side of the five ID units 4 in the carrying direction F.

The secondary transfer backup roller 31 is configured to be driven to rotate clockwise in this example according to the circular rotation of the transfer belt 11. The secondary transfer backup roller 31, in this example, is made of metal and is electrically grounded. The secondary transfer backup roller 31 is, as will be explained later, arranged so as to face the secondary transfer roller 32 (explained later) sandwiching the carrying path 20 for carrying the recording medium 9 and the transfer belt 11. The secondary transfer backup roller 31, together with the secondary transfer roller 32, constitutes a transfer part 30.

The reverse bending roller 15 is driven to rotate counterclockwise in this example according to the circular rotation of the transfer belt 11. The reverse bending roller 15, in this example, is arranged between the drive roller 12 and the secondary transfer backup roller 31, on the outside of the path circularly rotating the transfer belt 11.

Further, the image forming apparatus 1 is equipped with a rolled sheet feeder 21, a medium detection sensor 22, carrying rollers 23, a cutting part 24, a label detection sensor 25, carrying rollers 26, a secondary transfer roller 32, ejection sensors 27 and 28, a fuser 60, and ejection rollers 29. These members are arranged along the carrying path 20 for carrying the recording medium 9.

In the rolled sheet feeder 21, a recording medium 9, which is a rolled sheet, is set.

Figure 3:
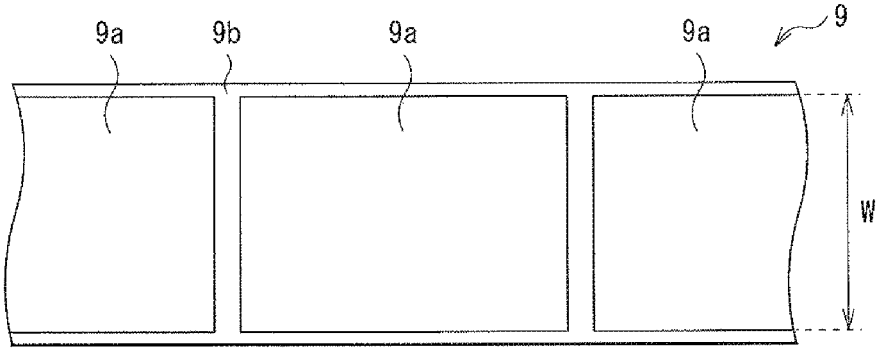
FIG. 3 is an explanatory view showing one configuration example of a recording medium shown in FIG. 1.

FIG. 3 shows one configuration example of the recording medium 9. The recording medium 9 includes labels 9*a* and a mount 9*b*. The labels 9*a* can be peeled off the mount 9*b* and pasted on various things. The label width of the label 9*a* is shown by "W". The image forming apparatus 1 is configured to form an image on the label 9*a*. In this example, the labels 9*a* are arranged side by side in the longitudinal direction of the recording medium 9.

The medium detection sensor 22 is a sensor for detecting that the recording medium 9 is being supplied to the carrying path 20 from the rolled sheet feeder 21. The carrying rollers 23 are constituted by a pair of rollers sandwiching the carrying path 20 and configured to carry the recording medium 9 so that the recording medium 9 supplied from the rolled sheet feeder 21 reaches an appropriate position at an appropriate timing. The cutting part 24 is configured to cut the recording medium 9 which is a rolled sheet. The cutting part 24 is configured to cut the recording medium 9, for example, when the power source of the image forming apparatus 1 is turned on or when a user performs an operation.

The label detection sensor 25 is an optical sensor for detecting that a medium has passed through. Especially, the sensor is directed to detect the label 9*a*, which is placed, The label detection sensor 25 includes a light emitting part 25*a* and a light receiving part 25*b*. The light emitting part 25*a* is configured to irradiate light and the light receiving part 25*b* is configured to receive the light emitted from the light emitting part 25*a*. The light emitting part 25*a* and the light receiving part 25*b* are arranged so as to face with each other across the carrying path 20. With this configuration, the label detection sensor 25 detects that the recording medium 9 has passed through based on the amount of light received by the light receiving part 25*b*. At that time, the label detection sensor 25 can detect whether the label 9*a* has passed or whether the mount 9*b* has passed.

Figures 4, 5:
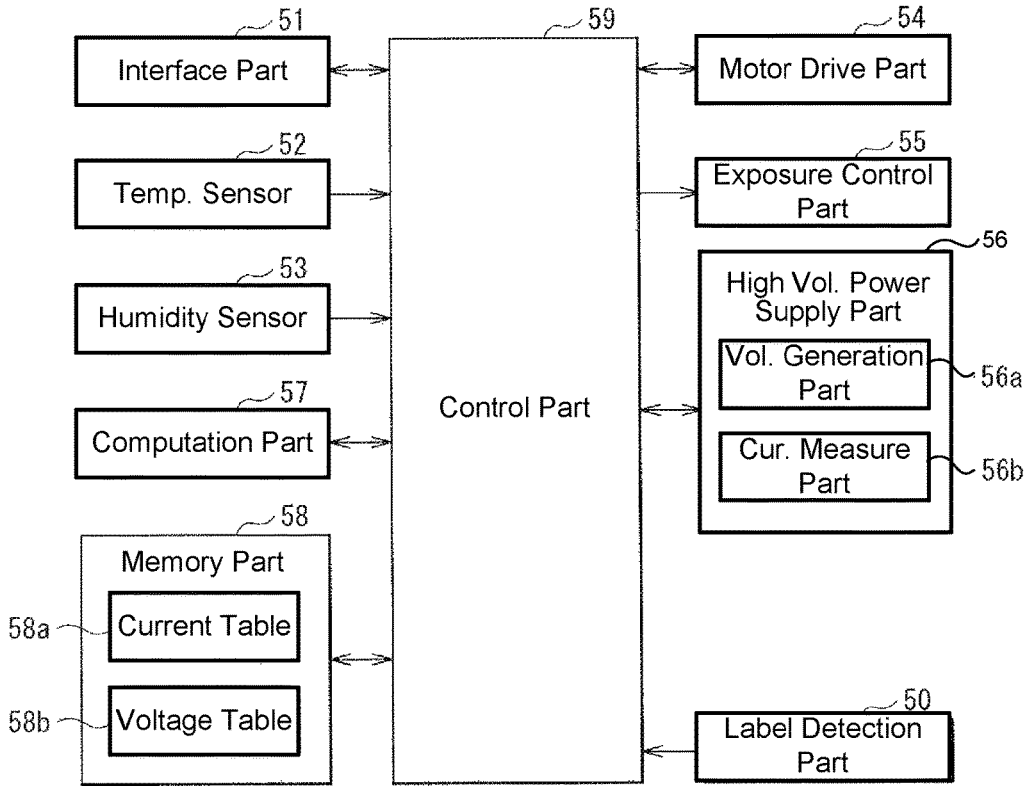
FIG. 4 is a table showing one characteristic example of a label detection sensor shown in FIG. 1.
FIG. 5 is a block diagram showing one configuration example of a control mechanism of the image forming apparatus shown in FIG. 1.

FIG. 4 shows one example of output voltages (detected voltages Vdet) of the light receiving part 25*b* of the label detection sensor 25. When there is no recording medium 9 between the light emitting part 25*a* and the light receiving part 25*b*, the amount of light received by the light receiving part 25*b* is large and as a result, the detected voltage Vdet becomes high. Further, when there is the mount 9*b* between the light emitting part 25*a* and the light receiving part 25*b*, since a part of the light irradiated from the light emitting part 25*a* is blocked by the mount 9*b*, the amount of light received by the light receiving part 25*b* decreases and as a result, the detected voltage Vdet becomes low. Further, when there is the label 9*a* and the mount 9*b* between the light emitting part 25*a* and the light receiving part 25*b*, the amount of light received by the light receiving part 25*b* further decreases and as a result, the detected voltage Vdet becomes even lower. In this way, in the image forming apparatus 1, the passing of the recording medium 9 can be detected based on the detected voltage Vdet.

The carrying rollers 26 are constituted by a pair of rollers sandwiching the carrying path 20 and configured to carry the recording medium 9 along the carrying path 20.

The secondary transfer roller 32 is a member for transferring the toner image on the target transfer face of the transfer belt 11 to the target transfer face of the recording medium 9. The secondary transfer roller 32 includes, for example, a shaft 32*a* made of metal and a semiconductive urethane rubber layer 32*b* covering the outer circumference (surface) of the shaft. The secondary transfer roller 32 is arranged so as to face the secondary transfer backup roller 31 sandwiching the transfer belt 11 and the carrying path 20. The secondary transfer roller 32, together with the secondary transfer backup roller 31, constitutes a transfer part 30. To the shaft 32*a* of the secondary transfer roller 32, as will be explained later, a positive transfer voltage Vtr is supplied via a resistance element 39 by a voltage generation part 56*a*. With this, in the image forming apparatus 1, the toner image on the target transfer face of the transfer belt 11 is transferred (secondary transferred) onto the target transfer face of the recording medium 9.

The ejection sensor 27 is a sensor for detecting that the recording medium 9 has passed the transfer part 30.

The fuser 60 is a member configured to fuse the toner image transferred onto the recording medium 9 to the recording medium 9 by applying heat and pressure to the recording medium 9. The fuser 60 includes a heat roller 61, a pressure application roller 62, and a temperature sensor 63. The heat roller 61 is a member, for example, including a heater such as a halogen lamp inside to apply heat to the toner on the recording medium 9. The pressure application roller 62 is a member arranged so as to form a press-contact part between it and the heat roller 61, and configured to apply pressure to the toner on the recording medium 9. The temperature sensor 63 is configured to detect the surface temperature of the heat roller 61 and the pressure application roller 62. With this, in the fuser 60, the toner on the recording medium 9 is heated, melted, and pressed. As a result, the toner image is fused on the recording medium 9.

The ejection sensor 28 is a sensor for detecting that the recording medium 9 has passed the fuser 60. The ejection roller 29 is a member constituted by a pair of rollers sandwiching the carrying path 20 and configured to eject the recording medium 9 to the outside of the image forming apparatus 1.

FIG. 5 shows one example of a control mechanism of the image forming apparatus 1. The image forming apparatus 1 includes an interface part 51, a temperature sensor 52, a humidity sensor 53, a motor drive part 54, an exposure control part 55, a high voltage power supply part 56, a label detection part 50, a computation part 57, a memory part 58, and a control part 59.

The interface part 51 is configured to, for example, receive print data from an unillustrated host computer and perform exchanges of various control signals with the host computer. The temperature sensor 52 is configured to detect the environmental temperature Ta of the image forming apparatus 1. The humidity sensor 53 is configured to detect the environmental humidity Ha of the image forming apparatus 1. The motor drive part 54 is configured to control the operation of each motor in the image forming apparatus 1. With this, the motor drive part 54 is configured to rotate each of the photosensitive bodies 41, the drive roller 12, the carrying rollers 23 and 26, the heat roller 61, and the ejection rollers 29. The exposure control part 55 is configured to control the exposure operation of each exposure device 6.

The high voltage power supply part 56 supplies voltage to the charge roller 42, the development roller 43, the supply roller 44, the toner blade 46 of each of the ID units 4, each of the primary transfer rollers 7, and the secondary transfer roller 32 of the transfer part 30. The high voltage power supply part 56 includes a voltage generation part 56*a* and a current measuring part 56*b*. The voltage generation part 56*a* generates a transfer voltage Vtr and supplies the transfer voltage Vtr to the shaft 32*a* of the secondary transfer roller 32 via a resistance element 39 (which will be explained later). The current measuring part 56*b* is configured to measure the transfer current Itr in the transfer part 30.

Figures 6, 7:
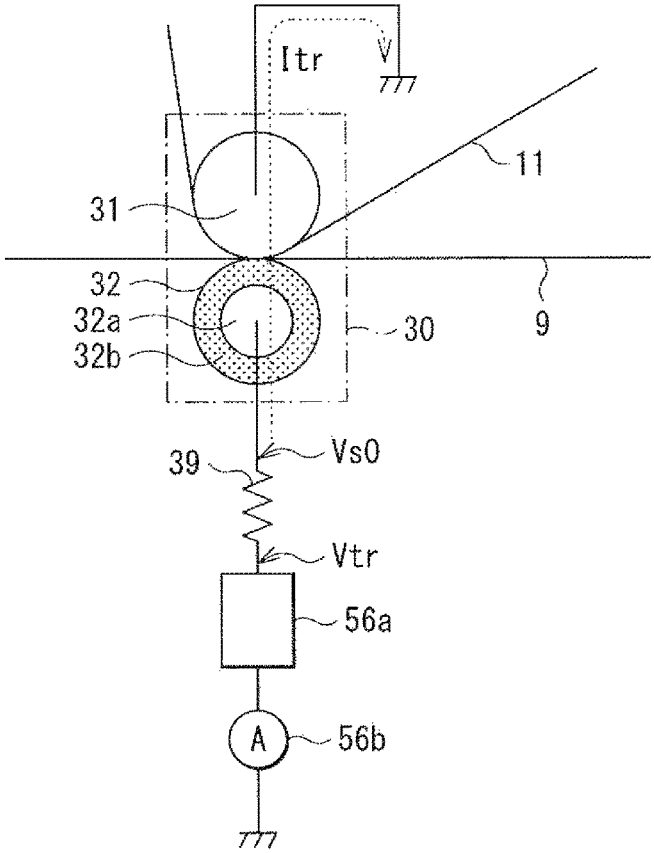
FIG. 6 is an explanatory view showing a supply of transfer voltage to a transfer part shown in FIG. 1.
FIG. 7 is a table showing one example of a current table shown in FIG. 5.

FIG. 6 shows an operation of supplying the transfer voltage Vtr to the transfer part 30. The output terminal of the voltage generation part 56*a* is connected to the shaft 32*a* of the secondary transfer roller 32 via the resistance element 39. The resistance element 39 has, for example, a resistance value R of a few MΩ and is provided to control the current flowing in the transfer part 30. The ground terminal of the voltage generation part 56*a* is grounded via the current measuring part 56*b*.

When the transfer part 30 transfers the toner image on the transfer belt 11 to the recording medium 9, the voltage generation part 56*a* generates a transfer voltage Vtr and supplies it to the secondary transfer roller 32 via the resistance element 39. With this, the transfer current Itr flows through the resistance element 39, the shaft 32*a*, the urethane rubber layer 32*b*, the recording medium 9, the transfer belt 11, and the secondary transfer backup roller 31 in this order. At that time, since the resistance value of each of these elements change due to, for example, the temperature and the humidity, the current value of the transfer current Itr changes, and as a result, the transfer characteristics of the toner image of the transfer part 30 may change. In the image forming apparatus 1, as will be explained later, the transfer voltage Vtr is determined so that the current density of the current flowing through the recording medium 9 and the potential difference between the voltage of the surface of the recording medium 9 and the voltage of the back surface of the recording medium 9 become approximately constant regardless of the temperature and the humidity. With this, in the image forming apparatus 1, excellent transfer characteristics can be obtained regardless of, for example, the temperature and the humidity.

The label detecting part 50 is configured to detect whether or not the label 9*a* has passed the label detection sensor 25 based on the detected voltage Vdet of the label detection sensor 25. Further, the label detection part 50 also has a function of detecting the position of the label 9*a* on the carrying path 20.

As will be explained later, the computation part 57 is configured to obtain the transfer voltage Vtr based on the environmental temperature Ta, the environmental humidity Ha, and the value of current flowing through the transfer part 30.

The memory part 58 is a nonvolatile memory and is configured to store a current table 58*a* and the voltage table 58*b*.

FIG. 7 shows one example of the current table 58*a*. The current table 58*a* shows the current density (medium current density Jp) of the current flowing through the recording medium 9 at which the transfer part 30 is capable of transferring the toner image to the label 9*a* of the recording medium 9 in an excellent manner. The medium current density Jp is a current value per unit length in the widthwise direction of the recording medium 9 (depth direction in FIG. 1) and the unit of the medium current density Jp is μA/mm in this example. The current table 58*a* includes medium current densities Jp at various temperatures and humidity.

FIG. 8 shows one example of the voltage table 58*b*. The voltage table 58*b* shows a potential difference (medium voltage density Vp) between the voltage of the surface of the recording medium 9 and the voltage of the back surface of the recording medium 9 at which the transfer part 30 is capable of transferring the toner image to the label 9*a* of the recording medium 9 in an excellent manner. The unit of the medium voltage Vp is kV in this example. The voltage table 58*b* includes medium voltages Vp at various temperatures and humidity.

FIGS. 7 and 8 are examples and are not limited to the values. That is, for example, the value of the medium current density Jp and the value of the medium voltage Vp change according to the print speed, for example. Further, for example, the medium current density Jp and the medium voltage Vp can be set by further dividing all of the temperature range and all of the humidity range, or the medium current density Jp and the medium voltage Vp can be set by dividing them more roughly. Further, a plurality of current tables 58*a* and voltage tables 58*b* may be provided and for example, one among the plurality of current tables 58*a* and one among the plurality of voltage tables 58*b* may be selected according to the type of recording medium 9 to be used.

The control part 59 is configured to control the overall operation of the image forming apparatus 1 by controlling the operations of various sensors shown in each of these blocks and in FIG. 1.

Further, the computation part 57 and the control part 59 may be configured to include, for example, a microprocessor, a ROM (Read Only Memory), a RAM (Random Access Memory), input/output ports, a timer, etc.

Here, the secondary transfer roller 32 corresponds to one specific example of a "transfer member" of the present invention. The secondary transfer backup roller 31 corresponds to one specific example of a "rotation member" of the present invention. The toner corresponds to one specific example of a "developer" of the present invention. The five ID units 4, the five exposure devices 6, the five primary transfer rollers 7, the transfer belt 11, and the transfer part 30 correspond to specific examples of the "image forming part" of the present invention. The current measuring part 56*b* corresponds to one specific example of the "measuring part" of the present invention. The computation part 57 and the control part 59 correspond to one specific example of the "control part" of the present invention. The temperature sensor 52 and the humidity sensor 53 correspond to one specific example of the "environment detection part" of the present invention. The region of the label 9*a* of the recording medium 9 corresponds to one specific example of the "transfer region" of the present invention, and the region other than the label 9*a* of the recording medium 9 corresponds to one specific example of the "non-transfer region" of the present invention.

The temperature sensor 52 detects an environmental temperature that includes various types of temperature indicating a working condition around the apparatus. Not only the apparatus's temperature but a temperature of a room in which the apparatus is placed also are available. The humidity sensor 53 detects an environmental humidity that includes various types of humidity indicating a working condition around the apparatus. For example, in addition to a humidity inside the apparatus, a room humidity as well is available. These sensors may be provided directly with the apparatus but may be equipped at anywhere other than the apparatus. Such a sensor, which is equipped remotely from the apparatus, can send sensed information to the apparatus with a cable or without a cable (or wirelessly). Wireless communication techniques, such as infrared transmission, WiFi, or Bluetooth, are available to achieve these communication between them. In order to collect these environmental temperature and humidity, multiple sensors can be used at multiple locations.

[Operations and Functions]

Next, operations and functions of the image forming apparatus 1 of this embodiment will be described.

(Summary of General Operations)

First, with reference to FIGS. 1, 2, and 5, the summary of the general operations of the image forming apparatus 1 will be described. In the image forming apparatus 1, after the control part 59 receives print data from a host computer via the interface part 51, the control part 59 first controls the fuser 60 and operates the heater of the heat roller 61.

When the temperature of the fuser 60 detected by the temperature sensor 63 reaches a temperature suitable for the fusing operation, the control part 59 controls the motor drive part 54 to rotate the photosensitive body 41 of each of the ID units 4. Then, the control part 59 controls the linear velocity of the photosensitive body 41 so that it becomes approximately the same as the carrying speed of the recording medium 9 at the time of printing. At the same time, the control part 59 controls the motor drive part 54 to rotate the drive roller 12, the carrying rollers 23 and 26, the heat roller 61, and the ejection rollers 29. Then, the control part 59 controls the carrying speed so that it becomes approximately the same as the carrying speed of the recording medium 9 at the time of printing.

Further, the control part 59 starts to rotate the photosensitive body 41 in this way, and also controls the high voltage power supply part 56 to apply a negative voltage (for example, −1,150V) to the charge roller 42. As a result, the photosensitive body 41 is charged to a negative voltage (for example, −700V). Further, the control part 59 controls the high voltage power supply part 56 to apply a negative voltage (for example, −300V) to the development roller 43.

Then, in the ID unit 4, when the photosensitive body 41 rotates and the negatively charged portion of the photosensitive body 41 reaches the nip part between the photosensitive body 41 and the primary transfer roller 7, the ID unit 4 becomes in a printable state.

Next, the control part 59 controls the motor drive part 54 to carry the recording medium 9 to a predetermined position from the rolled sheet feeder 21 along the carrying path 20 based on the detection result of the medium detection sensor 22. Then, the control part 59, based on the detection result of the label detection sensor 25, obtains the timing in which the front end of the recording medium 9 reaches the nip part between the secondary transfer backup roller 31 and the secondary transfer roller 32 in the transfer part 30.

Next, the control part 59, based on the print data, generates image data to be formed by each of the ID units 4. Then, the control part 59, considering the timing in which the front end of the recording medium 9 reaches the nip part, controls the exposure control part 55 at a predetermined timing to expose the photosensitive body 41 of each of the ID units 4 with each of the exposure devices 6. With this, in each of the ID units 4, the voltage of the exposed portion among the surface of the photosensitive body 41 becomes about 0 V and an electrostatic latent image is formed.

The control part 59 controls the high voltage power supply part 56 to apply a negative voltage (for example, −400V) to the supply roller 44 and apply a negative voltage to the toner blade 46 (for example, −400V). With this, the supply roller 44 charges the toner to a negative voltage and supplies the toner to the development roller 43. The toner supplied to the development roller 43 is regulated by the toner blade 46 and is charged to a negative voltage. Since the electrical potential of the exposed portion of the surface of the photosensitive body 41 is about 0 V, the toner charged to a negative voltage on the development roller 43 moves to the exposed portion on the surface of the photosensitive body 41 from the development roller 43 due to Coulomb force. With this, on the photosensitive body 41, the toner image is developed as a visible image.

The control part 59 controls the high voltage power supply part 56 to apply a positive voltage (for example, +1,500V) to each of the primary transfer rollers 7. With this, the toner charged to a negative voltage on the photosensitive body 41 moves to the transfer belt 11 from the photosensitive body 41 due to Coulomb force.

The control part 59 controls the high voltage power supply part 56 to supply the positive transfer voltage Vtr determined by the computation part 57 to the secondary transfer roller 32 via the resistance element 39. With this, the toner charged to a negative voltage on the transfer belt 11 moves to the recording medium 9 from the transfer belt 11 due to Coulomb force.

The toner on the recording medium 9 is heated, melted, and pressed by the fuser 60. As a result, the toner image is fused on the recording medium 9.

(Detail Operations)

Next, operations of determining the transfer voltage Vtr applied to the secondary transfer roller 32 will be described in detail.

Figure 9:
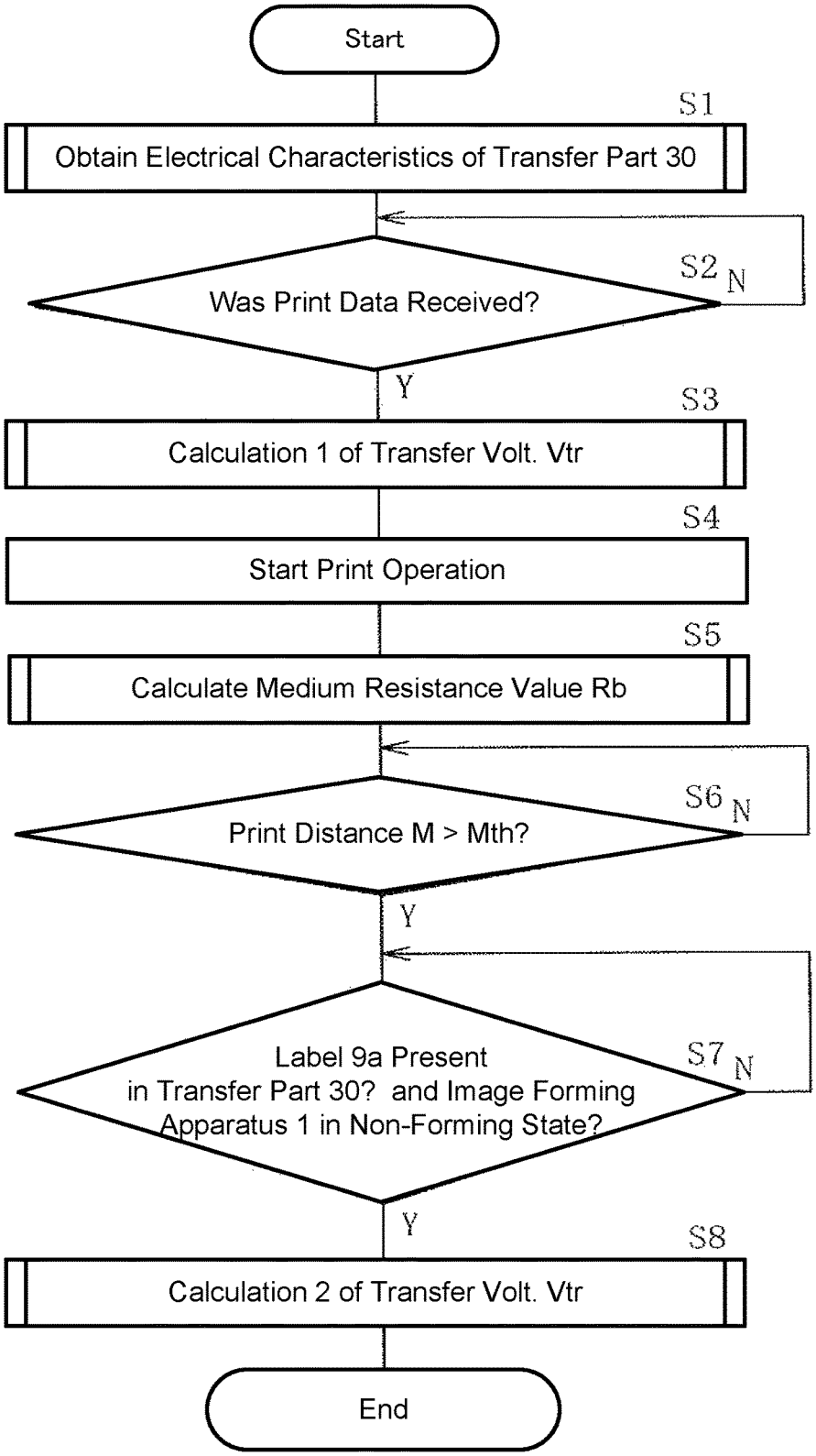
FIG. 9 is a flowchart showing one operational example of the image forming apparatus shown in FIG. 1.

FIG. 9 shows a flowchart of the operations to determine the transfer voltage Vtr. First, after turning on the power, the image forming apparatus 1 obtains the electrical characteristics of the transfer part 30 in a state in which there is no recording medium 9 in the transfer part 30. Then, the image forming apparatus 1 determines the transfer voltage Vtr after receiving the print data, and starts printing. After that, the image forming apparatus 1 determines a transfer voltage Vtr again when the print distance M becomes a predetermined distance Mth or more. Hereinafter, this operation will be described in detail. The print distance M is a distance along the carrying path 20, is defined as a length in which the sheet is carried for printing.

First, after the power of the image forming apparatus 1 is turned on, the image forming apparatus 1 obtains the electrical characteristics of the transfer part 30 (S1).

(Obtaining Electrical Characteristics of Transfer Part 30)

Figure 10:
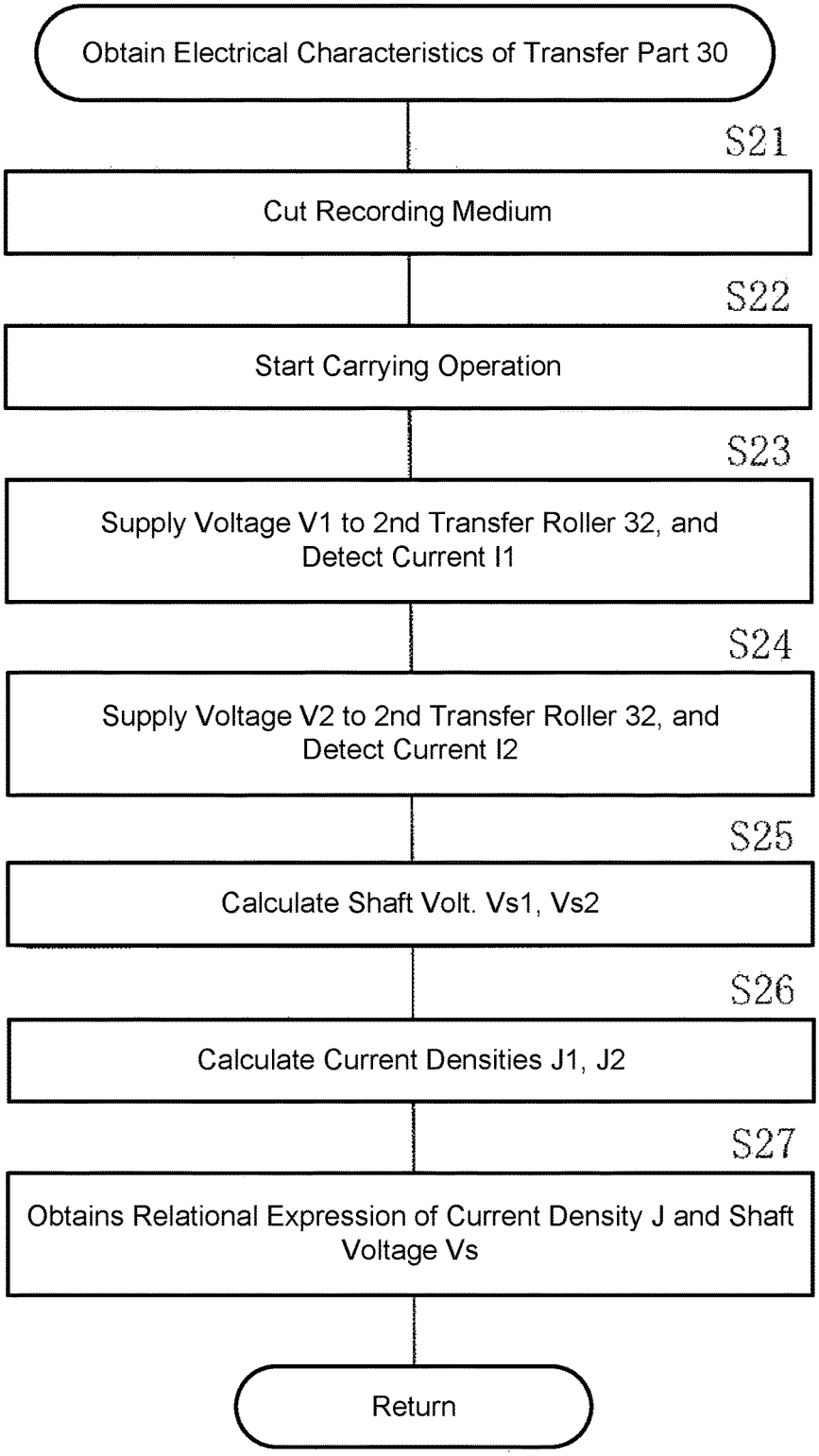
FIG. 10 is a flowchart showing one example of an operation to obtain electrical characteristics of the transfer part shown in FIG. 9.

FIG. 10 shows a flowchart of the operations to obtain electrical characteristics of the transfer part 30.

First, the control part 59 of the image forming apparatus 1 controls the cutting part 24 to cut the recording medium 9 (S21). Then, the image forming apparatus 1 starts the carrying operation (Step S22). Specifically, the control part 59 controls the motor drive part 54 to rotate the drive roller 12, the carrying rollers 26, the heat roller 61, and the ejection rollers 29. With this, the transfer part 30 becomes in a state in which there is no recording medium 9.

Next, the image forming apparatus 1 supplies a voltage V1 to the secondary transfer roller 32 via the resistance element 39 and detects the current I1 (S23). Specifically, the voltage generation part 56*a* of the high voltage power supply part 56 generates a voltage V1 based on instructions from the control part 59. Then, the current measuring part 56*b* detects the current I1 and supplies the detected result to the control part 59.

Next, the image forming apparatus 1 supplies a voltage V2 that is different from the voltage V1 to the secondary transfer roller 32 via the resistance element 39, and detects the current I2 (S24). Specifically, the voltage generation part 56*a* generates the voltage V2 based on the instructions from the control part 59. Then, the current measuring part 56*b* detects the current I2 and supplies the detected result to the control part 59.

Further, in this example, currents I1 and I2 are each detected once, but it is not limited to that, and for example, the current I1 can be detected a plurality of times and the average value can be obtained and the current I2 can be detected a plurality of times and the average value can be obtained.

Next, the computation part 57 of the image forming apparatus 1 calculates shaft voltages Vs (Vs1, Vs2) of the shaft 32*a* at the time of supplying a voltage in Steps S23 and S24 (S25). That is, since the voltage generation part 56*a* supplies a voltage to the secondary transfer roller 32 via the resistance element 39, the shaft voltage of the shaft 32*a* is different from the voltage generated by the voltage generation part 56*a*. The shaft voltages Vs1 and Vs2 can be shown as follows using the resistance value R of the resistance element 39.

[Formula 1]

$$\left.\begin{aligned} Vs1 &= V1 - R \times I1 \\ Vs2 &= V2 - R \times I2 \end{aligned}\right\} \quad (1)$$

The computation part 57 calculates the shaft voltages Vs1 and Vs2 using the aforementioned formula (1).

Next, the computation part 57 calculates a current density J (J1, J2) of the transfer part 30 at the time of supplying the voltage in Steps S23 and S24 (S26). Here, the current densities J1 and J2 are current values per unit of length in the lengthwise direction (depth direction in FIG. 1) of the secondary transfer roller 32, and the unit of the current densities J1 and J2 are, for example, μA/mm. When the length of the secondary transfer roller 32 is L, the current densities J1 and J2 can be shown as follows:

[Formula 2]

$$\left.\begin{aligned} J1 &= \frac{I1}{L} \\ J2 &= \frac{I2}{L} \end{aligned}\right\} \quad (2)$$

The computation part 57 calculates the current densities J1 and J2 using the aforementioned formula (2).

Next, the computation part 57 obtains the relational expression of the current density J and the shaft voltage Vs by linear approximation (S27).

The current density J can be shown as follows using the shaft voltage Vs and coefficients a and b.

[Formula 3]

$$\left.\begin{aligned} J &= a \times Vs + b \\ a &= \frac{J2 - J1}{Vs2 - Vs1} \\ b &= \frac{J1 \times Vs2 - J2 \times Vs1}{Vs2 - Vs1} \end{aligned}\right\} \quad (3)$$

The computation part 57 calculates the coefficients a and b using the shaft voltages Vs1 and V2 calculated in Step S25 (formula (1)), the current densities J1 and J2 calculated in Step S26 (formula (2)) and the aforementioned formula (3).

In addition, the operation to obtain the electrical characteristics of the transfer part 30 (S21 to S27) may be performed at least once after turning on the power and before the start of printing.

With the above, the flow of obtaining the electrical characteristics of the transfer part 30 is completed.

Next, as shown in FIG. 9, the control part 59 of the image forming apparatus 1 confirms whether or not the print data has been received (S2). If the print data has not been received ("N" in S2), the flow returns to Step S2. Then, Step S2 is repeated until print data is received.

Then, when the print data is received ("Y" in S2), the image forming apparatus 1 calculates the transfer voltage Vtr (S3).

(Calculation 1 of Transfer Voltage Vtr)

Figure 11:
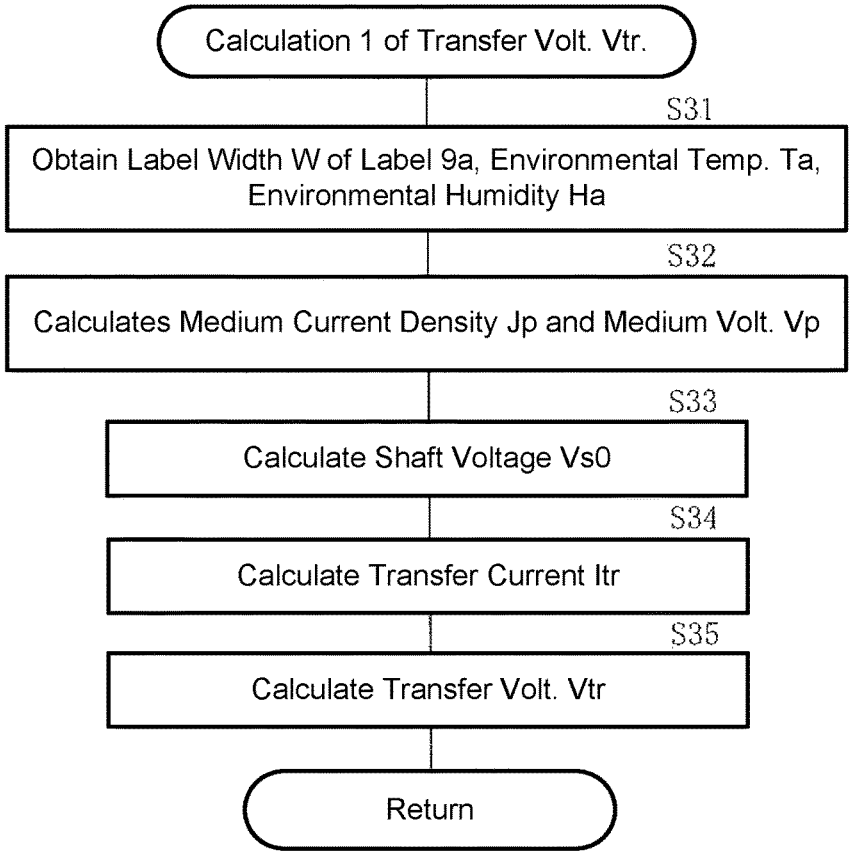
FIG. 11 is a flowchart showing one example of an operation to calculate a first transfer voltage shown in FIG. 9.

FIG. 11 shows a flowchart of the operations to calculate the transfer voltage Vtr.

First, the control part 59 of the image forming apparatus 1 obtains information for the label width W of the label 9*a* included in the print data and also obtains the environmental temperature Ta detected by the temperature sensor 52 and the environmental humidity Ha detected by the humidity sensor 53 (S31). Further, in this example, the label width W of the label 9*a* is obtained based on the print data, but it is not limited to that. Specifically, for example, when the image forming apparatus 1 is equipped with a detector for sensing the label width W of the label 9*a*, the control part 59 can obtain the label width W from the detector.

Next, the computation part 57 of the image forming apparatus 1 calculates the medium current density Jp and the medium voltage Vp (S32). Specifically, the computation part 57 calculates the medium current density Jp and the medium voltage Vp using the environmental temperature Ta and the environmental humidity Ha obtained in Step S31 and utilizing the current table 58*a* and the voltage table 58*b*.

Next, the computation part 57 obtains a shaft voltage Vs0 capable of realizing the medium current density Jp and the medium voltage Vp obtained in Step S32 (S33).

Figure 12:
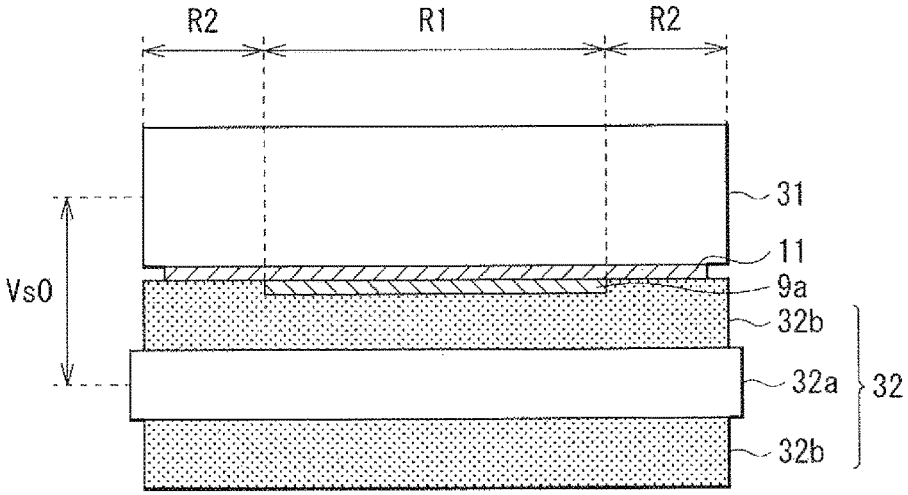
FIG. 12 is an explanatory view showing one operational example of the transfer part shown in FIG. 1.

FIG. 12 schematically depicts the transfer part 30 viewed from the direction of the carrying path 20. FIG. 12 shows a case in which a recording medium 9 is present in the transfer part 30. In this drawing, for the convenience of description, the mount 9*b* is not depicted. That is, in the following description, only the label 9*a* of the recording medium 9 is considered with the assumption that effects of the mount 9*b* is small. The recording medium 9 (label 9*a*) is sandwiched between the transfer belt 11 and the urethane rubber layer 32*b* of the secondary transfer roller 32. In the drawing, in the lengthwise direction of the secondary transfer roller 32 (lateral direction in FIG. 12), the region in which the label 9*a* is present is shown as a region R1 and the region in which the label 9*a* is not present is shown as a region R2. In this example, since the secondary transfer backup roller 31 is grounded, the voltage between the secondary transfer backup roller 31 and the shaft 32*a* is the shaft voltage Vs0.

Attention will be focused on the region R1. The shaft voltage Vs0 can be shown as follows.

[Formula 4]

$$Vs0 = Vin + Vp \quad (4)$$

Here, the voltage Vin is a voltage occurring in the transfer belt 11 and the urethane rubber layer 32*b*. That is, the first item on the right side shows the contribution by the transfer belt 11 and the urethane rubber layer 132*b* and the second item on the right side shows the contribution by the label 9*a* of the recording medium 9. In the region R1, the current density in the transfer belt 11 and the urethane rubber layer 32*b* is approximately the same as the current density of the current flowing through the recording medium 9 (medium current density Jp). Therefore, the voltage Vin can be shown as follows using the formula (3).

[Formula 5]

$$Vin = \frac{Jp - b}{a} \quad (5)$$

Therefore, the shaft voltage Vs0 can be shown as follows using the formulas (4) and (5).

[Formula 6]

$$Vs0 = \frac{Jp - b}{a} + Vp \quad (6)$$

The computation part 57 calculates the shaft voltage Vs0 using the aforementioned formula (6).

Next, the computation part 57 calculates the transfer current Itr (S34). First, attention will be focused on the region R2. Since both the secondary transfer backup roller 31 and the shaft 32*a* are made of metallic, the shaft voltage Vs0 obtained while focusing on the region R1 in Step S33 can also be used in the region R2.

Since no label 9*a* is present in the region R2, the relational expression (formula (3)) for the current density J and the shaft voltage Vs in a case in which there are no recording medium 9 in the transfer part 30 as obtained in Step S27 can be used. The current density Jout of the current flowing through the region R2 can be shown as follows using the formula (3).

[Formula 7]

$$Jout=a\times Vs0+b \tag{7}$$

The transfer current Itr can be shown as follows using the formula (7)

[Formula 8]

$$\begin{aligned} Itr &= Jp\times W + Jout\times(L-W) \\ &= Jp\times W + (a\times Vs0+b)\times(L-W) \end{aligned} \tag{8}$$

Here, the first item on the right side shows the contribution by the region R1 and the second item on the right side shows the contribution by the region R2. The computation part 57 calculates the transfer current Itr using the formula (8).

Next, the computation part 57 calculates the transfer voltage Vtr to be generated by the voltage generation part 56*a* (S35). As shown in FIG. 4, the voltage generation part 56*a* supplies a voltage to the shaft 32*a* of the secondary transfer roller 32 via the resistance element 39. Therefore, the transfer voltage Vtr to be generated by the voltage generation part 56*a* can be shown as follows.

[Formula 9]

$$Vtr=Vs0+R\times Itr \tag{9}$$

Here, the first item on the right side shows the contribution by the transfer part 30 and the second item on the right side shows the contribution by the resistance element 39. The computation part 57 calculates the transfer voltage Vtr using the shaft voltage Vs0 calculated in Step S33 (formula (4)), the transfer current Itr calculated in Step S34 (formula (8)) and the aforementioned formula (9).

With the above, the flow of the operation to calculate the transfer voltage Vtr is completed.

Next, as shown in FIG. 9, the image forming apparatus 1 starts the print operation (S4). At that time, the voltage generation part 56*a* generates the transfer voltage Vtr obtained in Step S3 and supplies the transfer voltage Vtr to the secondary transfer roller 32 via the resistance element 39 based on the instructions from the control part 59. With this, since the current density of the current flowing in the recording medium 9 can be set around the medium current density Jp and the potential difference between the voltage of the surface of the recording medium 9 and the back surface of the recording medium 9 can be set around the medium voltage Vp, excellent transfer characteristics can be obtained.

Next, the image forming apparatus 1 calculates the medium resistance value Rb (S5).

(Calculation of Medium Resistance Value Rb)

Figure 13:
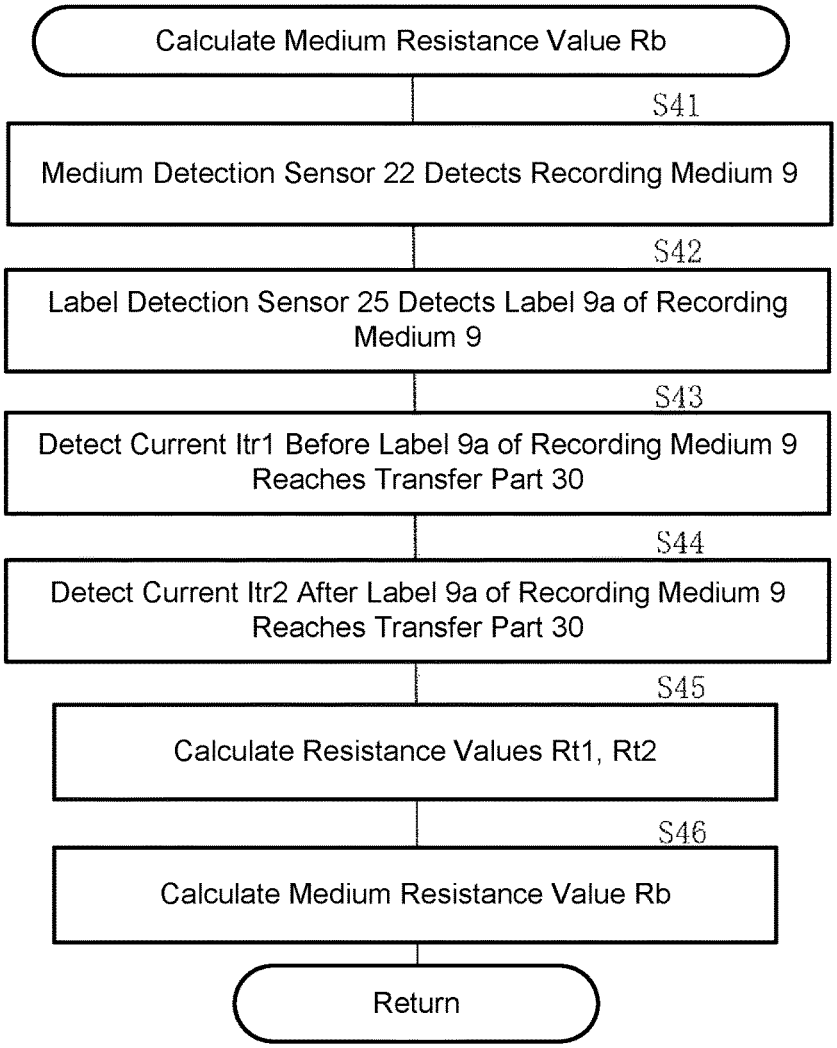
FIG. 13 is a flowchart showing one example of an operation to calculate a medium resistance value shown in FIG. 9.

FIG. 13 is a flowchart of the operations to calculate the medium resistance value Rb.

First, the medium detection sensor 22 detects the recording medium 9 (S41).

Next, the label detection sensor 25 detects the label 9*a* of the recording medium 9 (S42). The label detection part 50, based on the detected result of the label detection sensor 25, hereinafter obtains the position of the label 9*a* on the carrying path 20.

Next, the current measuring part 56*b* of the image forming apparatus 1 detects the current Itr1 before the label 9*a* of the recording medium 9 reaches the transfer part 30 (S43). That is, the image forming apparatus 1 has already started the printing operation in Step S4 and the voltage generation part 56*a* supplies the transfer voltage Vtr to the secondary transfer roller 32 via the resistance element 39. Therefore, the current measuring part 56*b* detects the current Itr1 that flows according to the transfer voltage Vtr before the label 9*a* of the recording medium 9 reaches the transfer part 30. Then, the current measuring part 56*b* supplies the detected result to the control part 59.

Next, the current measuring part 56*b* detects the current Itr2 after the label 9*a* of the recording medium 9 reaches the transfer part 30 (S44). Then, the current measuring part 56*b* supplies the detected result to the control part 59.

Next, the computation part 57 calculates a resistance value Rt1 of the transfer part 30 when no label 9*a* of the recording medium 9 is present in the transfer part 30 and a resistance value Rt2 of the transfer part 30 when the label 9*a* of the recording medium 9 is present in the transfer part 30 (S45). Specifically, the resistance values Rt1 and Rt2 of the transfer part 30 can be shown as follows.

[Formula 10]

$$\left.\begin{aligned} Rt1 &= \frac{Vtr}{Itr1} - R \\ Rt2 &= \frac{Vtr}{Itr2} - R \end{aligned}\right\} \tag{10}$$

The computation part 57 calculates the resistance values Rt1 and Rt2 of the transfer part 30 based on the aforementioned formulas.

Next, the computation part 57 calculates a medium resistance value Rb (S46). First, attention will be focused on the region R1. The resistance value Rt3 of the transfer part 30 in the region R1 can be shown as follows using the medium resistance value Rb and the resistance value Rt1 of the transfer part 30 in a state in which no label 9*a* of the recording medium 9 is present in the transfer part 30.

[Formula 11]

$$Rt3 = Rb + Rt1\times\frac{L}{W} \tag{11}$$

Here, the second item on the right side is the total resistance value of the resistance value of the transfer belt 11 and the resistance value of the urethane rubber layer 32*b* in the region R1.

Next, attention will be focused on the region R2. The resistance value Rt4 of the transfer part 30 in the region R2 can be shown as follows using the resistance value Rt3 of the transfer part 30 in the region R1 and the resistance value Rt2 of the transfer part 30 in a state in which the label 9*a* of the recording medium 9 is present in the transfer part 30.

[Formula 12]

$$Rt4 = \frac{Rt2\times Rt3}{Rt2 - Rt3} \tag{12}$$

The medium resistance value Rb can be shown as follows using the formulas (11) and (12).

[Formula 13]

$$Rb = \frac{Rt2 \times Rt4}{Rt2 - Rt4} + \frac{Rt1 \times (Rt4 - Rt2)}{Rt2 - Rt4} \times \frac{L}{W} \tag{13}$$

The computation part 57 calculates the medium resistance value Rb using the resistance values Rt1 and Rt2 calculated in Step S45 (formula (10)), the resistance value Rt4 calculated in Step S46 (formula (12)) and the aforementioned formula (13).

With the above, the flow of calculation of the medium resistance value Rb is completed.

Next, as shown in FIG. 9, the control part 59 of the image forming apparatus 1 confirms whether or not the print distance M in the recording medium 9 after starting printing in Step S4 is longer than the predetermined distance Mth (for example, 1 m) (M>Mth) (S6). When the print distance M is equal to or shorter than the predetermined distance Mth (M≤Mth) ("N" in S6), the flow returns to Step S6. Then, Step S6 is repeated until the print distance M becomes longer than the predetermined distance Mth.

When the print distance M is longer than the predetermined distance Mth ("Y" in S6), the control part 59 confirms whether or not the label 9*a* is present in the transfer part 30 and that the image forming apparatus 1 in a state in which it is not forming an image (S7).

Figure 14:
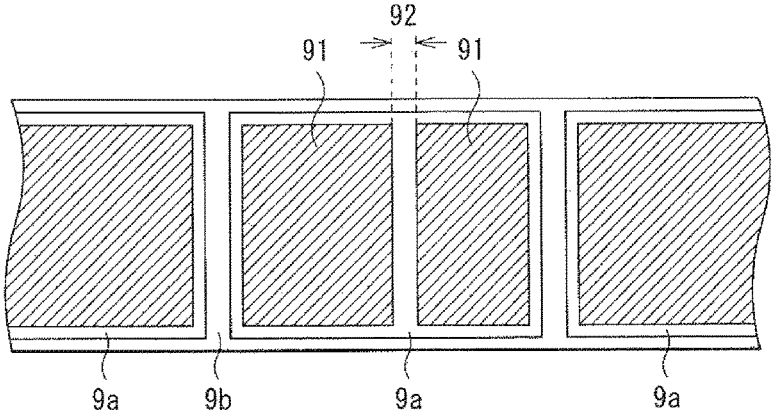
FIG. 14 is an explanatory view showing an example an image forming result of the image forming apparatus shown in FIG. 1.

FIG. 14 schematically shows the recording medium 9 after an image is formed. In FIG. 14, the region 91 shows a region of a label 9*a* in which an image is formed and the region 92 shows a region of the label 9*a* in which no image is formed. The control part 59 confirms whether or not the transfer part 30 is forming an image by transferring a toner image like in the region 91 or not forming an image like in the region 92. In cases where no label 9*a* is present in the transfer part 30, or the image forming apparatus 1 is not in a non-forming state (or the apparatus 1 is forming an image), the step determines No ("N" in S7), the flow returns to Step S7. Then, Step S7 is repeated until the step determines YES, which is defined follow. Only where a label 9*a* is present in the transfer part 30 and the image forming apparatus 1 is in the non-forming state in which the apparatus 1 is not forming an image, the step determines YES.

Then, when it becomes in a state in which a label 9*a* is present in the transfer part 30 and the image forming apparatus 1 is not forming an image ("Y" in S7), the image forming apparatus 1 calculates the transfer voltage Vtr again (S8).

(Calculation 2 of Transfer Voltage Vtr)

Figure 15:
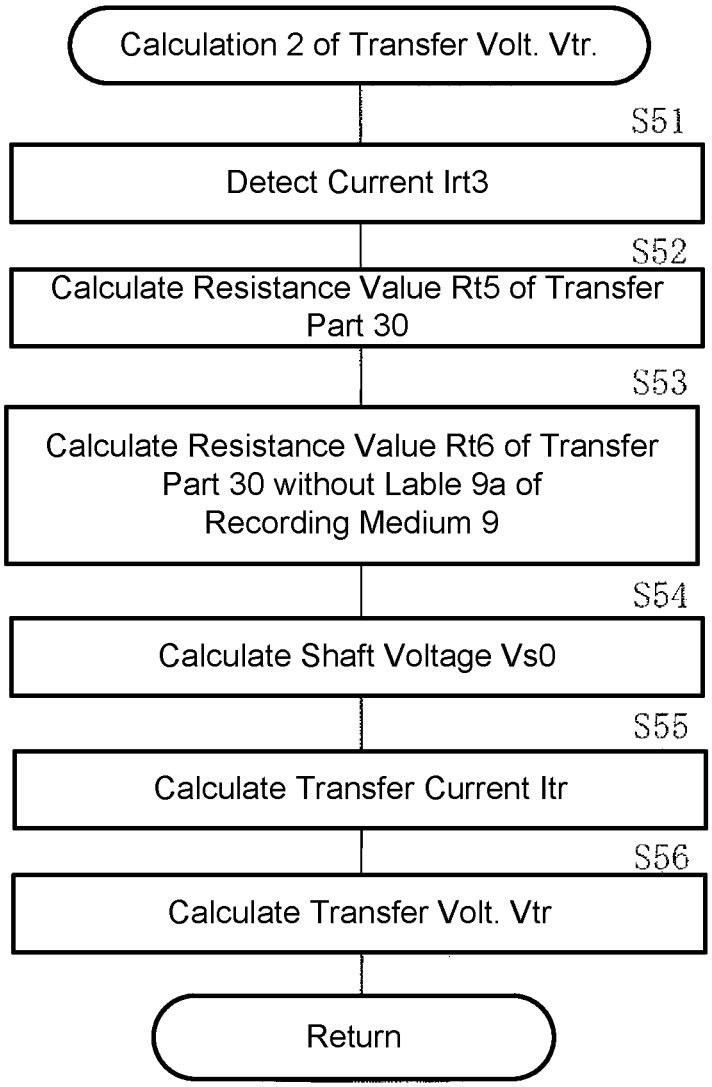
FIG. 15 is a flowchart showing one example of an operation to calculate a second transfer voltage shown in FIG. 1.

FIG. 15 shows a flowchart of an operation to calculate the transfer voltage Vtr.

First, the current measuring part 56*b* of the image forming apparatus 1 detects a current Itr3 (S51). That is, at this time, the voltage generation part 56*a* is supplying the transfer voltage Vtr to the secondary transfer roller 32 via the resistance element 39 and a label 9*a* of a recording medium 9 has already reached the transfer part 30. Therefore, the current measuring part 56*b* detects a current Itr3 in a state in which the label 9*a* of the recording medium 9 is present in the transfer part 30. Then, the current measuring part 56*b* supplies the detected result to the control part 59.

Next, the computation part 57 calculates a resistance value Rt5 of the transfer part 30 in a state in which the label 9*a* of the recording medium 9 is present in the transfer part 30 (S52). Specifically, the resistance value Rt5 of the transfer part 30 can be shown as follows.

[Formula 14]

$$Rt5 = \frac{Vtr}{Itr3} - R \tag{14}$$

The computation part 57 calculates the resistance value Rt5 of the transfer part 30 using the formula (14).

Next, the computation part 57 calculates the resistance value Rt6 of the transfer part 30 in a state in which no label 9*a* of the recording medium 9 is present in the transfer part 30 (S53). The resistance value Rt5 of the transfer part 30 in a state in which the label 9*a* of the recording medium 9 is present in the transfer part 30 and the resistance value Rt6 of the transfer part 30 in a state in which no label 9*a* of the recording medium 9 is present in the transfer part 30 have the following relationship.

[Formula 15]

$$\frac{1}{Rt5} = \frac{1}{Rb + Rt6 \times \frac{L}{W}} + \frac{1}{Rt6 \times \frac{L}{L - W}} \tag{15}$$

Here, the first item on the right side shows a conductance in the region R1 and the second item on the right side shows a conductance in the region R2. The following formula is obtained by arranging the formula (15) about the resistance value Rt6.

[Formula 16]

$$L^2 \lambda Rt6^2 - (L^2 \times Rt5 - W \times L \times Rb) \times Rt6 + W \times (L - W) \times Rb \times Rt5 = 0 \tag{16}$$

The next formula is obtained by solving the formula (16) for the resistance value Rt6.

[Formula 17]

$$Rt6 = \frac{\left( L^2 \times Rt5 - W \times L \times Rb \pm \sqrt{(L^2 \times Rt5 - W \times L \times Rb)^2 - 4 \times L^2 \times W \times (L - W) \times Rb \times Rt5} \right)}{2 \times L^2} \tag{17}$$

The positive value among the two values obtained using the formula (17) is the resistance value Rt6. The computation part 57 calculates the resistance value Rt6 of the transfer part 30 in a state in which no label 9*a* of the recording medium 9 is present in the transfer part 30 using the medium resistance value Rb calculated in Step S5 (formula (13)), the resistance value Rt5 calculated in Step S52 (formula (14)) and the aforementioned formula (17).

Next, the computation part 57 obtains a shaft voltage Vs0 (S54). Focusing on the region R1, the shaft voltage Vs0 can be shown by the formula (4). Focusing on region R2, the voltage Vin can be shown as follows.

[Formula 18]

$$Vin = Jp \times (L - W) \times Rt6 \times \frac{L}{L - W} = Jp \times Rt6 \times L \quad (18)$$

Therefore, the shaft voltage Vs0 can be shown as follows using the formulas (4) and (18).

[Formula 19]

$$Vs0 = Vin + Vp = Jp \times Rt6 \times L + Vp \quad (19)$$

The computation part 57 calculates the shaft voltage Vs0 using the resistance value Rt6 calculated in Step S53, the medium current density Jp and the medium voltage Vp calculated in Step S32, and this formula.

Next, the computation part 57 calculates a transfer current Itr (S55). First, attention will be focused on the region R2. Since both the secondary transfer backup roller 31 and the shaft 32*a* are made of metallic, the shaft voltage Vs0 obtained by focusing on the region R1 in Step S54 can also be used in the region R2. The current Tout flowing through the region R2 can be shown as follows.

[Formula 20]

$$Iout = \frac{Vs0}{Rt6 \times \frac{L}{L - W}} \quad (20)$$

Therefore, the transfer current Itr can be shown as follows using the formula (20).

[Formula 21]

$$Itr = Jp \times W + Iout = Jp \times W + \frac{Vs0}{Rt6 \times \frac{L}{L - W}} \quad (21)$$

Here, the first item on the right side shows a contribution by the region R1 and the second item on the right side shows a contribution by the region R2. The computation part 57 calculates the transfer current Itr using the resistance value Rt6 calculated in Step S53 (formula (17)), the shaft voltage Vs0 calculated in Step S54 (formula (19)) and the aforementioned formula (21).

Next, the computation part 57 calculates a transfer voltage Vtr to be generated by the voltage generation part 56*a* (S56). The transfer voltage Vtr to be generated by the voltage generation part 56*a* can be shown as follows.

[Formula 22]

$$Vtr = Vs0 + R \times Itr \quad (22)$$

The computation part 57 calculates the transfer voltage Vtr using the shaft voltage Vs0 calculated in Step S54 (formula (19)), the transfer current Itr calculated in Step S55 (formula (21)), and the aforementioned formula (22).

With the above, the flow of the operation to calculate the transfer voltage Vtr is completed.

The voltage generation part 56*a*, during a period in which no image is being formed, generates a transfer voltage Vtr based on the instructions from the control part 59 and supplies the transfer voltage Vtr to the secondary transfer roller 32 via the resistance element 39. That is, the transfer voltage Vtr is updated during a period in which no image is being formed. Then, after that, the image forming apparatus 1 continues the print operation. With this, the current density of the current flowing through the recording medium 9 can be brought closer to the medium current density Jp, and the potential difference between the voltage of the surface of the recording medium 9 and the voltage of the back surface of the recording medium 9 can be brought closer to the medium voltage Vp, and therefore excellent transfer characteristics can be obtained.

In this way, when the print distance M is longer than the predetermined distance Mth, the image forming apparatus 1 obtains the resistance value Rt5 of the transfer part 30 in a state in which the label 9*a* of the recording medium 9 is present in the transfer part 30. Then, based on the resistance value Rt5, the resistance value Rt6 of the transfer part 30 in a state in which no label 9*a* of the recording medium 9 is present in the transfer part 30 is obtained, and the transfer voltage Vtr is obtained based on the resistance value Rt6. With this, the image quality can be improved in the image forming apparatus 1. That is, when performing printing continuously for a long period of time, the resistance value of the transfer part 30 may change due to the generation of heat, for example. In this case, for example, the current density in the recording medium 9 may deviate from the desired medium current density Jp, or the potential difference between the voltage of the surface of the recording medium 9 and the voltage of the back surface of the recording medium 9 may deviate from the desired medium voltage Vp. As a result, the transfer characteristics in the transfer part 30 deteriorate, and for example, print failure may occur, such as fading of the characters. In particular, when the recording medium 9 is a rolled sheet, since printing is performed continuously for a long period of time, once printing is started, printing failure occurs easily. When the print distance M is longer than the predetermined distance Mth, the image forming apparatus 1 obtains the resistance value Rt5 of the transfer part 30 and the transfer voltage Vtr is obtained based on the resistance value Rt5. With this, even when printing is performed continuously for a long period of time, the current density of the current flowing through the recording medium 9 can be brought closer to the medium current density Jp and the potential difference between the voltage of the surface of the recording medium 9 and the voltage of the back surface of the recording medium 9 can be brought closer to the medium voltage Vp. As a result, excellent transfer characteristics can be obtained and the image quality can be improved in the image forming apparatus 1.

Further, in the image forming apparatus 1, since the resistance value Rt5 of the transfer part 30 is obtained during a period in which no image is being formed, the transfer voltage Vtr can be obtained accurately. That is, for example, when the resistance value Rt5 of the transfer part 30 is obtained during a period in which the image forming apparatus 1 is forming an image, the resistance value Rt5 may be affected by the toner since a toner exists in the transfer part 30. Therefore, when the transfer voltage Vtr is obtained based on the resistance value Rt5, for example, the current density in the recording medium 9 may deviate from the desired medium current density Jp, or the potential difference between the voltage of the surface of the recording medium 9 and the voltage of the back surface of the recording medium 9 may deviate from the desired medium voltage Vp. In the image forming apparatus 1, during the period in which no image is being formed, the resistance value Rt5 of the transfer part 30 is obtained and the transfer voltage Vtr is obtained based on the resistance value Rt5. With this, the transfer voltage Vtr can be accurately obtained without being affected by a toner. As a result, excellent transfer characteristics can be obtained and the image quality can be improved in the image forming apparatus 1.

Further, in the image forming apparatus 1, since the transfer voltage Vtr is updated during the period in which no image is being formed, the image quality can be improved. That is, for example, when the transfer voltage Vtr is updated when the image forming apparatus 1 is forming an image, since the transfer characteristics change largely within one image, the image quality may deteriorate. In the image forming apparatus 1, since the transfer voltage Vtr is updated during a period in which no image is formed, the transfer characteristics do not change largely within one image, so the risk of the deterioration of the image quality can be reduced.

[Effects]

In this embodiment, as explained above, since the resistance value in a state in which a label of the recording medium is present at the transfer part is obtained, and the transfer voltage is obtained based on the resistance value, the image quality can be improved even when printing continuously for a long period of time.

Further, in this embodiment, since the resistance value in a state in which a recording medium is present at the transfer part is obtained during a period in which no image is being formed, the transfer voltage can be accurately obtained, and as a result, the image quality can be improved.

Further, in this embodiment, since the transfer voltage is updated during a period in which no image is being formed, the image quality can be improved.

Modified Embodiment 1-1

In the aforementioned embodiment, the toner image formed by each of the ID units 4 is transferred (primary transfer) onto the target transfer face of the transfer belt 11 and then the toner image on the target transfer face of the transfer belt 11 is transferred (secondary transfer) onto the target transfer face of the recording medium 9, but not limited to that. Alternately, a toner image formed by each of the ID units 4 may be directly transferred onto the target transfer face of the recording medium 9. In this case, the computation part 57 may calculate each transfer voltage of the five transfer rollers facing each of the five ID units 4. However, it is not limited to that, and for example, the transfer voltage may be calculated using the aforementioned method for only some of the five transfer rollers and the transfer voltages of the remaining transfer rollers may be roughly estimated using the calculated result. Specifically, for example, the transfer voltage of the transfer roller arranged on the most upstream side and the transfer voltage of the transfer roller arranged on the most downstream side among the five transfer rollers may be calculated using the aforementioned method.

Modified Embodiment 1-2

In the aforementioned embodiment, the predetermined distance Mth is set to 1 m, for example, but it is not limited to that. That is, for example, the value of the predetermined distance Mth may change according to, for example, the print speed, the material of the secondary transfer roller 32, etc. Therefore, for example, it is preferably set for each type of image forming apparatus 1.

Modified Embodiment 1-3

In the aforementioned embodiment, the computation part 57 obtains the transfer voltage Vtr when the print distance M is longer than the predetermined distance Mth, but it is not limited to that. Alternatively, for example, the transfer voltage Vtr may be obtained when the temperature of the transfer part 30 is higher than the predetermined temperature. With this configuration, printing is performed continuously for a long period of time and when the temperature of the transfer part 30 becomes higher than the predetermined temperature, the computation part obtains the transfer voltage Vtr. With this, the image quality can be improved in the same manner as the aforementioned embodiment. Herein, the temperature of the transfer part may be measured at any surface of, inside, or in the vicinity of the transfer part 30. Other temperature surrounding the transfer part may be available for the temperature.

Modified Embodiment 1-4

In the aforementioned embodiment, the cutting part 24 cuts the recording medium 9 to attain a state in which no recording medium 9 is present in the transfer part 30, but not limited to that. For example, it becomes in a state in which no recording medium 9 is present in the transfer part 30 even when the rolled sheet is replenished when there is no recording medium 9 in the rolled sheet feeder 21. Therefore, the aforementioned technology may be applied in such a case.

Modified Embodiment 1-5

In the aforementioned embodiment, when the current measuring part 56*b* of the high voltage power supply part 66 measures the current, the current may be detected a plurality of times while changing the roller angle of the secondary transfer roller 32. Hereinafter, an image forming apparatus according to this modified embodiment will be explained in detail.

Figure 16:
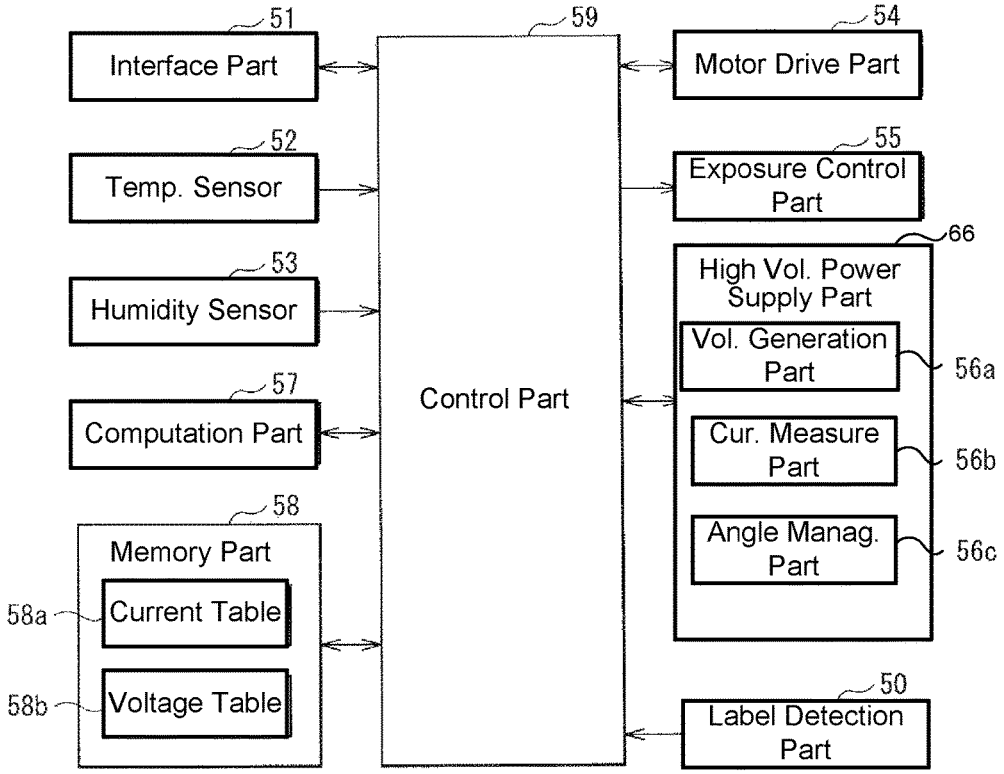
FIG. 16 is a block diagram showing one configuration example of a control mechanism of an image forming apparatus according to a modified example.

FIG. 16 shows one example of a control mechanism of the image forming apparatus. The image forming apparatus is equipped with a high voltage power supply part 66. The high voltage power supply part 66 is equipped with an angle management part 56*c*. The angle management part 56*c* is configured to manage the roller angle of the secondary transfer roller 32. Specifically, the angle management part 56*c* is configured to manage the roller angle of the secondary transfer roller 32 so that the current measuring part 56*b* measures the current under a plurality of conditions in which the roller angles of the secondary transfer roller 32 are different.

Hereinafter, the operation when measuring the current Itr2 after the label 9*a* of the recording medium 9 reaches the transfer part 30 in the flow for calculating the medium resistance value Rb will be exemplified for explanation.

Figure 17A:
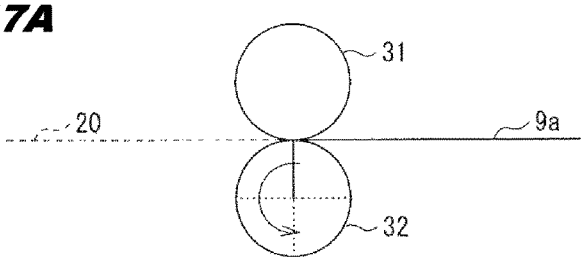
FIG. 17A is an explanatory view showing one operational example of an angle management part shown in FIG. 16.
Figure 17B:
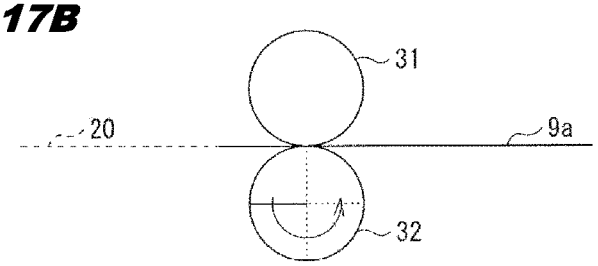
FIG. 17B is another explanatory view showing one operational example of an angle management part shown in FIG. 16.
Figure 17C:
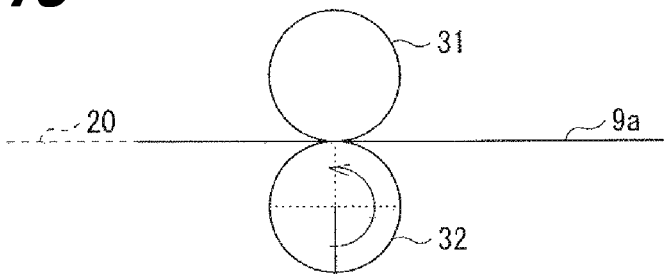
FIG. 17C is another explanatory view showing one operational example of an angle management part shown in FIG. 16.
Figure 17D:
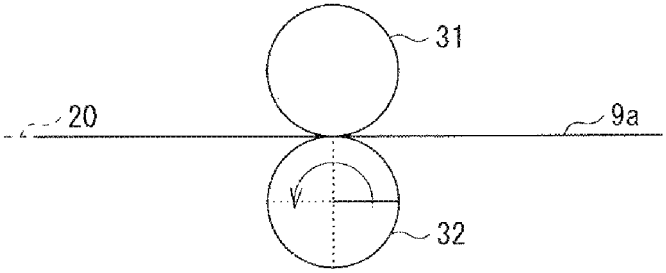
FIG. 17D is another explanatory view showing one operational example of an angle management part shown in FIG. 16.

FIGS. 17A to 17D show roller angles of the secondary transfer rollers 32. In this example, first, as shown in FIG. 17A, the current Itr2 is measured when the label 9*a* of the recording medium 9 has reached the transfer part 30. Next, as shown in FIG. 17B, the current Itr2 is measured when the secondary transfer roller 32 rotates by 90 degrees from when the label 9*a* of the recording medium 9 has reached the transfer part 30 (FIG. 17A). After that, the current Itr2 is measured when the secondary transfer roller 32 rotates by 180 degrees from when the label 9*a* of the recording medium 9 has reached the transfer part 30 (FIG. 17A) and the current Itr2 is measured when the secondary transfer roller 32 rotates by 270 degrees from when the label 9*a* of the recording medium 9 has reached the transfer part 30 (FIG. 17A). In this way, in this example, the current Itr2 is measured four times while changing the roller angle of the secondary transfer roller 32.

Figure 18:
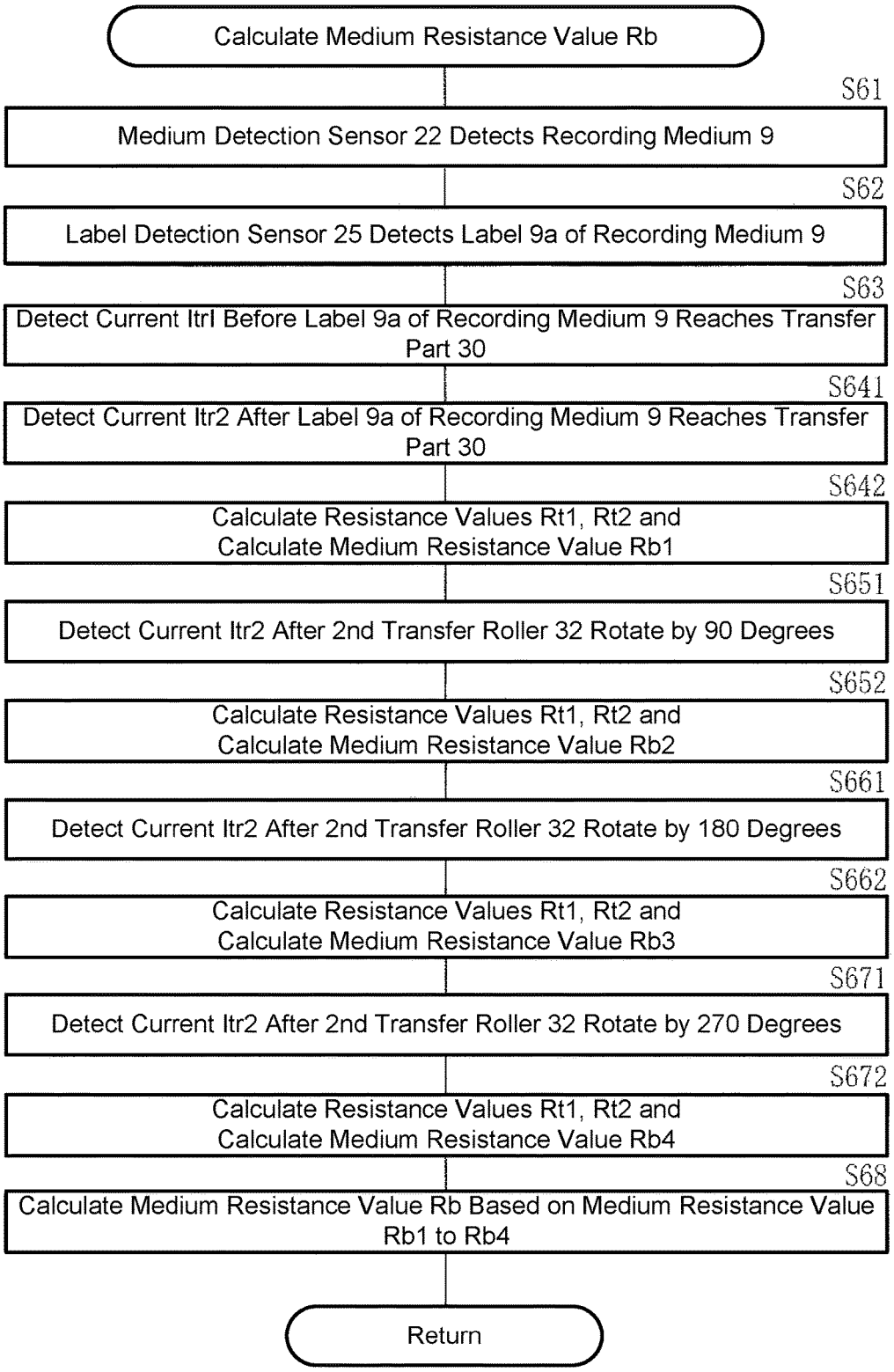
FIG. 18 is a flowchart showing one example of an operation to calculate a medium resistance value in an image forming apparatus according to a modified example.

FIG. 18 shows a flowchart of the operation to calculate the medium resistance value Rb.

First, the medium detection sensor 22 detects the recording medium 9 (S61) and next, the label detection sensor 25 detects the label 9*a* of the recording medium 9 (S62). Then, the current measuring part 56*b* of the image forming apparatus 1 detects the current Itr1 before the label 9*a* of the recording medium 9 reaches the transfer part 30 (S63). These operations are the same as those in Steps S41 to S43 of FIG. 13.

Next, the current measuring part 56*b* detects the current Itr2 after the label 9*a* of the recording medium 9 reaches the transfer part 30 (S641). That is, the current measuring part 56*b* detects the current Itr2 in the state shown in FIG. 17A. Then, the computation part 57 calculates the resistance values Rt1 and Rt2 of the transfer part 30 and calculates the medium resistance value Rb1 (S642). These operations are the same as those in Steps S44 to S46 of FIG. 13.

Next, the current measuring part 56*b* detects the current Itr2 after the secondary transfer roller 32 rotates by 90 degrees (S651). That is, the current measuring part 56*b* detects the current Itr2 in the state shown in FIG. 17B. Then, the computation part 57 calculates the resistance values Rt1 and Rt2 of the transfer part 30 and calculates the medium resistance value Rb2 (S652). These operations are the same as those in Steps S44 to S46 of FIG. 13.

Next, the current measuring part 56*b* detects the current Itr2 after the secondary transfer roller 32 rotates by 180 degrees (S661). That is, the current measuring part 56*b* detects the current Itr2 in the state shown in FIG. 17C. Then, the computation part 57 calculates the resistance values Rt1 and Rt2 of the transfer part 30 and calculates the medium resistance value Rb3 (S662). These operations are the same as those in Steps S44 to S46 of FIG. 13.

Next, the current measuring part 56*b* detects the current Itr2 after the secondary transfer roller 32 rotates by 270 degrees (S671). That is, the current measuring part 56*b* detects the current Itr2 in the state shown in FIG. 17D. Then, the computation part 57 calculates the resistance values Rt1 and Rt2 of the transfer part 30 and calculates the medium resistance value Rb4 (S672). These operations are the same as those in Steps S44 to S46 of FIG. 13.

Then, the computation part 57 calculates the medium resistance value Rb based on the medium resistance values Rb1 to Rb4 obtained in Steps S642, S652, S662, and S672 (S68). Specifically, the computation part 57, for example, calculates the medium resistance value Rb by calculating the average value of the four medium resistance values Rb1 to Rb4.

With the above, the flow of the calculation of the medium resistance value Rb is completed.

In this way, in the image forming apparatus, since the current is detected a plurality of times while changing the roller angle of the secondary transfer roller 32, for example, the resistance value of the urethane rubber layer 32*b* of the secondary transfer roller 32 is not constant and even when they are different according to the roller angle, the effects can be suppressed. As a result, in the image forming apparatus, since the accuracy of the calculation of the transfer voltage Vtr can be improved, the image quality can be improved.

2. Embodiment 2

Next, an image forming apparatus 2 according to a second embodiment will be described. This embodiment is configured to form an image on a label in which the label width W is not constant. In addition, the same symbols are allotted to the components that are essentially the same as the components of the image forming apparatus 1 according to the aforementioned first embodiment and the explanations will be omitted.

As shown in FIG. 1, the image forming apparatus 2 has the same structure as the image forming apparatus 1. This image forming apparatus 2 is configured to form an image on a recording medium 8.

Figure 19:
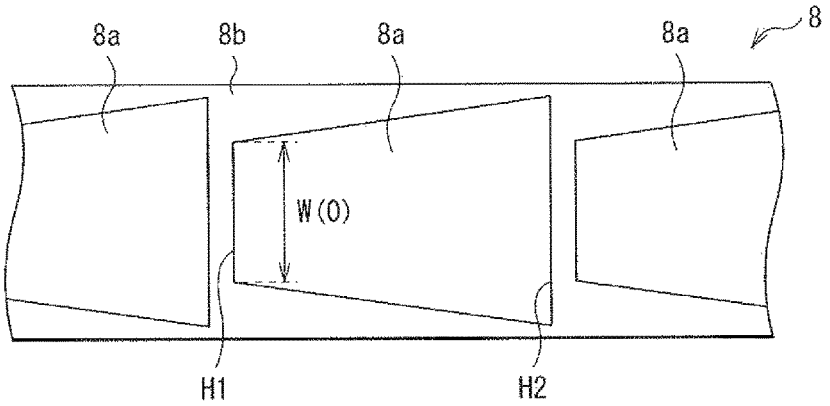
FIG. 19 is an explanatory view showing one configuration example of a recording medium according to a second embodiment.

FIG. 19 shows one configuration example of the recording medium 8. The recording medium 8 includes a label 8*a* and a mount 8*b*. The label 8*a* has a trapezoidal shape in this embodiment. The label 8*a* has sides H1 and H2 parallel to each other. The transfer part 30 performs the transfer sequentially from the left side of the label 8*a* (side H1). The label width of the left end of the label 8*a* (side H1) is W (0).

Figure 20:
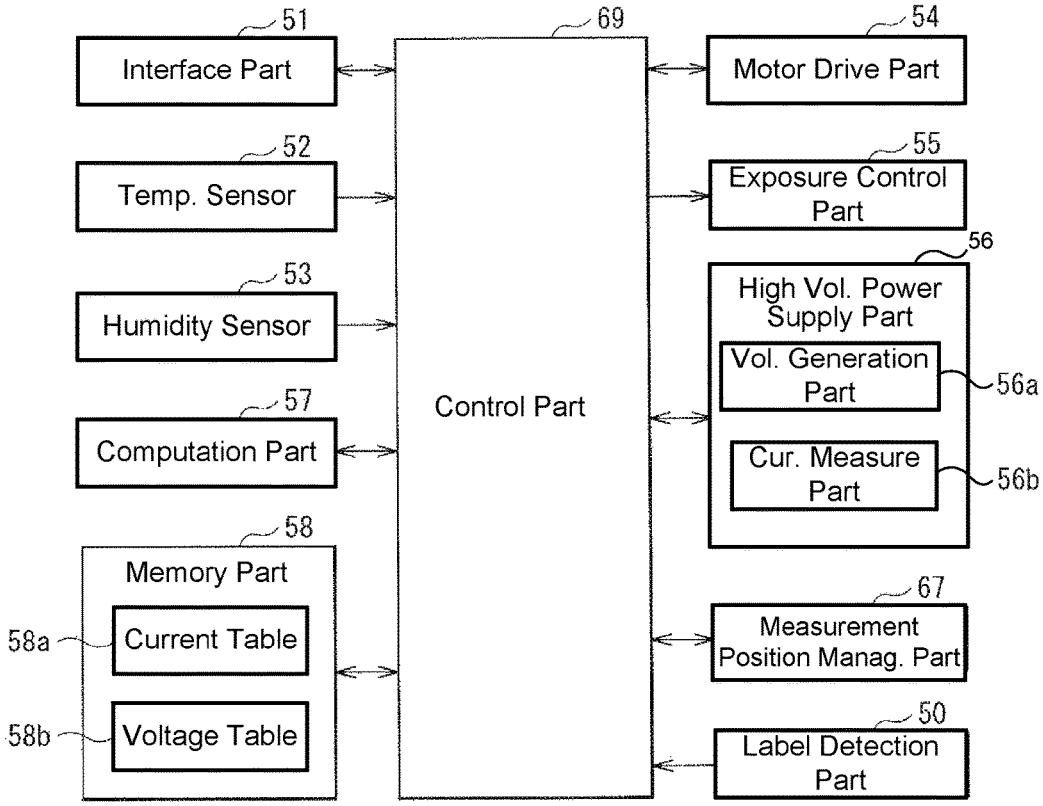
FIG. 20 is a block diagram showing one configuration example of a control mechanism of an image forming apparatus according to a second embodiment.

FIG. 20 shows one example of the control mechanism of the image forming apparatus 2. The image forming apparatus 2 is equipped with a measurement position management part 67 and a control part 69. The measurement position management part 67 is configured to manage the position for measuring the current within the label 8*a*. Specifically, the measurement position management part 67, as explained later, is configured to manage the position for measuring the current in the label 8*a* so that the current measuring part 56*b* measures the current at various positions in the label 8*a*. The control part 69 is configured to manage the overall operation of the image forming apparatus 2.

Figure 21:
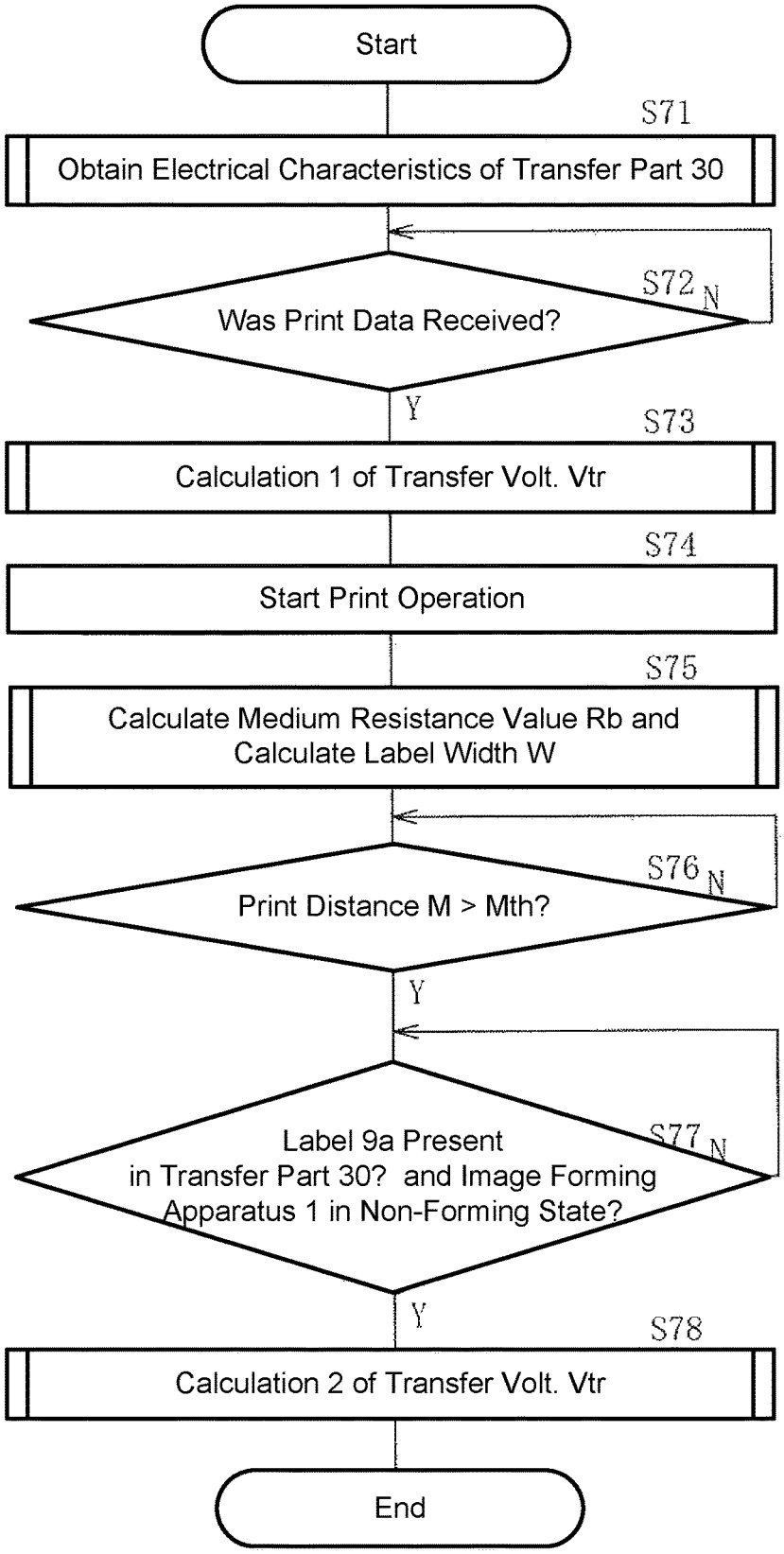
FIG. 21 is a flowchart showing one operational example of the image forming apparatus shown in FIG. 20.

FIG. 21 shows a flowchart of the operation to determine the transfer voltage Vtr.

When the power of the image forming apparatus 2 is turned on, the image forming apparatus 2 obtains the electrical characteristics of the transfer part 30 (S71), receives print data (S72), calculates the transfer voltage Vtr (S73), and starts the print operation (S74). These operations are the same as those in Steps S1 to S4 according to the first embodiment (such as FIG. 9).

Next, the image forming apparatus 2 calculates the medium resistance value Rb and the label width W (S75). Specifically, the image forming apparatus 2, as will be explained later, calculates the medium resistance value Rb using the first label 8*a* among the plurality of labels 8*a* arranged side by side in the recording medium 8 and calculates the label width W of the labels 8*a* at predetermined intervals. That is, since the label width W of the label 8*a* is not constant, the image forming apparatus 2 calculates the label width W at predetermined intervals.

Next, the control part 69 of the image forming apparatus 2 confirms whether or not the print distance M in the recording medium 8 after starting printing in Step S74 is longer than the predetermined distance Mth (for example, 1 m) (M>Mth) (S76). When the print distance M is longer than the predetermined distance Mth ("Y" in S76), the control part 69 confirms whether or not the label 8*a* is present in the transfer part 30 and that the image forming apparatus 2 is in the non-forming state in which no image is being formed (S77). Then, when it becomes in a state in which the label 8*a* is present in the transfer part 30 and the image forming apparatus 2 is not forming images ("Y" is S77), the image forming apparatus 2 calculates the transfer voltage Vtr again (S78). At that time, the image forming apparatus 2 calculates the transfer voltage Vtr using the second and later labels 8*a* among the plurality of labels 8*a* arranged side by side in the recording medium 8.

(Calculation of Medium Resistance Value Rb and Label Width W)

Figure 22:
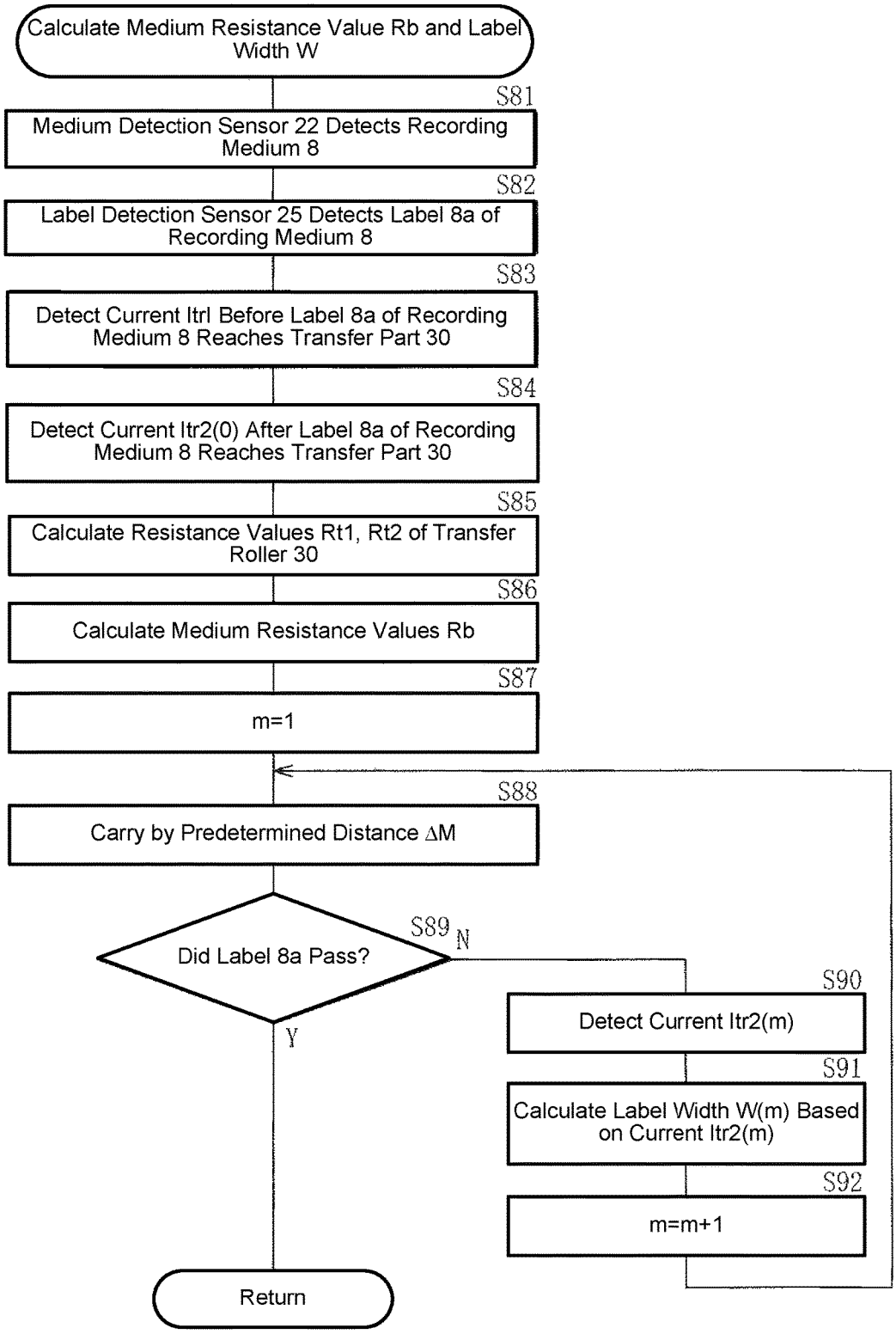
FIG. 22 is a flowchart showing one example of an operation to calculate a medium resistance value and a label width shown in FIG. 21.

FIG. 22 shows a flowchart of the operation to calculate the medium resistance value Rb and the label width W.

First, the medium detection sensor 22 detects the recording medium 8 (S81) and next, the label detection sensor 25 detects the first label 8*a* of the recording medium 8 (S82). Then, the current measuring part 56*b* of the image forming apparatus 2 detects the current Itr1 before the label 8*a* of the recording medium 8 reaches the transfer part 30 (S83). Next, the current measuring part 56*b* detects the current Itr2(0) after the label 8*a* of the recording medium 8 has reached the transfer part 30 (S84). Then, the computation part 57 calculates the resistance values Rt1 and Rt2 of the transfer part 30 (S85) and calculates the medium resistance value Rb3 (S86). These operations are the same as those in Steps 41 to 46 (FIG. 13) of the aforementioned first embodiment. Further, in Step S86, the computation part 57 performs a calculation using the label width W (0) shown in FIG. 19. That is, since the current Itr2(0) is a current value when the vicinity of the side H1 of the label 8*a* is in the transfer part 30, the computation part 57 performs the calculation using the label W(0) in the vicinity of the side H1.

Next, the measurement position management part 67 sets the variable m to 1 (m=1) (S87). Then, the control part 69 controls the motor drive part 54 and carries the recording medium 9 along the carrying path 20 by the predetermined distance ΔM (for example, 10 mm) only (S88).

Next, the label detection part 50 confirms whether or not the label 8*a* has passed the transfer part 30 (S89). When the label 8*a* has passed the transfer part 30 ("Y" in S89), the flow is completed.

In Step S89, when the label 8*a* has not passed the transfer part 30 ("N" in S89), the current measuring part 56*b* detects the current Itr2 (*m*) (S90). That is, in Step S74, the image forming apparatus 2 has already started the print operation, and the voltage generation part 56*a* is supplying the transfer voltage Vtr to the secondary transfer roller 32 via the resistance element 39. Therefore, the current measuring part 56*b* detects the current Itr2 (*m*) flowing according to the transfer voltage Vtr when the label 8*a* of the recording medium 8 is present in the transfer part 30. The current Itr2 (*m*) is a current value measured at a position m×ΔM away from the side H1 of the label 8*a*.

Next, the computation part 57 calculates the label width W (m) at the position using the following formula based on the current Itr2 (*m*) detected in Step S90 (S91). The label width W (m) is obtained using the formula (11) and shown as follows.

[Formula 23]

$$W(m) = \frac{a \times Vs0 \times L - b \times L - Itr2(m)}{a \times Vs0 + b - J} \tag{23}$$

For example, when the current Itr2 (*m*) detected in Step S90 is approximately equal to the current Itr2 (0) detected in Step S84, the label width W (m) is approximately equal to the label width W (0).

Next, the measurement position management part 67 increments the variable m (S92) and returns to Step S88. Then, Steps S88 to S92 are repeated until the label 8*a* passes the transfer part 30.

In this way, the image forming apparatus 2 calculates the medium resistance value Rb and the label width W (m) for each predetermined interval using the first label 8*a* of the recording medium 8.

(Calculation 2 of Transfer Voltage Vtr)

Then, the image forming apparatus 2 calculates the transfer voltage Vtr using the second or later labels 8*a* as will be explained below.

Figure 23:
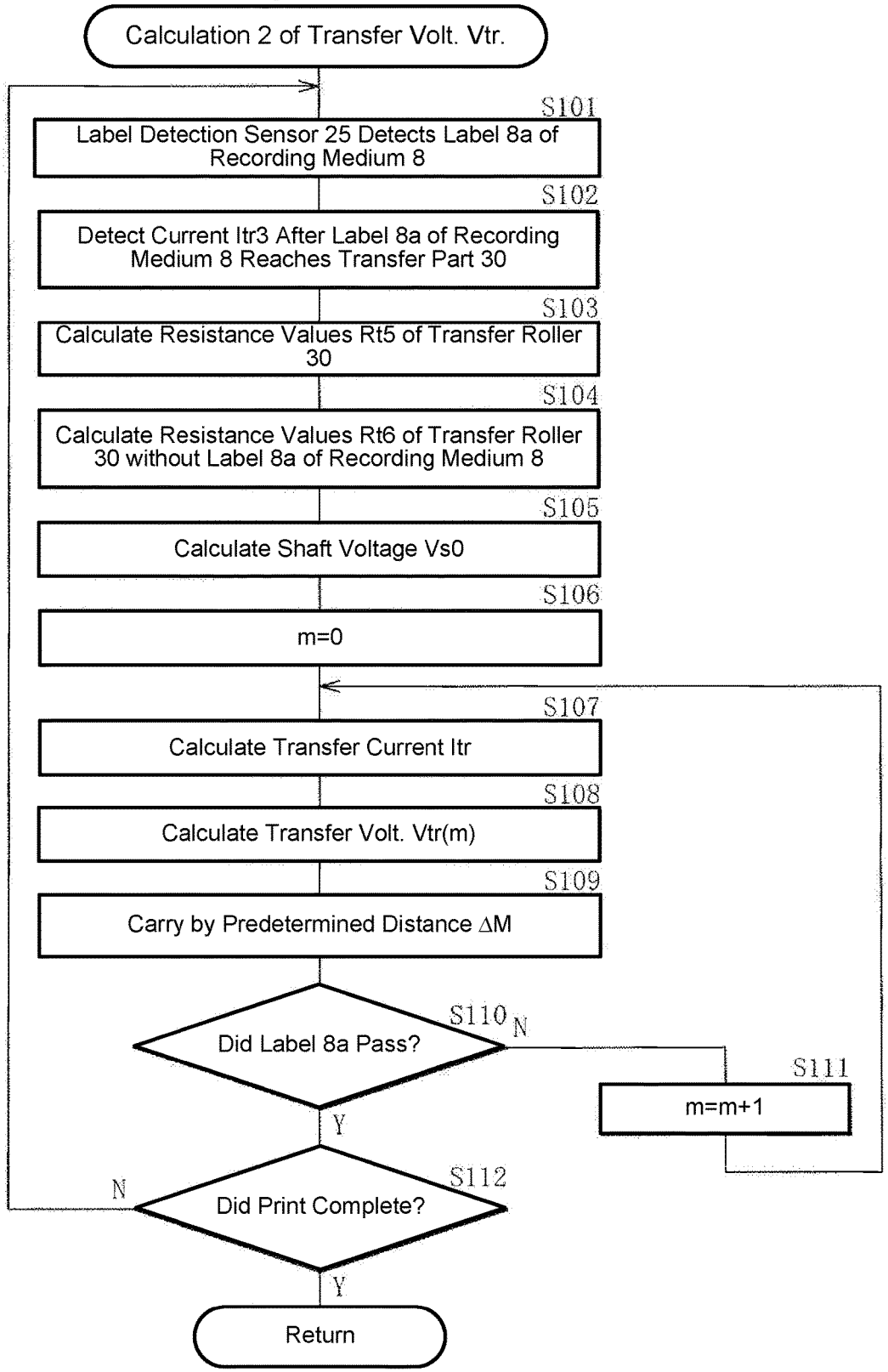
FIG. 23 is a flowchart showing one example of an operation to calculate a second transfer voltage shown in FIG. 21.

FIG. 23 shows a flowchart of the operations to calculate the transfer voltage Vtr.

First, the label detection sensor 25 detects the next label 8*a* of the recording medium 8 (S101) and after the label 8*a* has reached the transfer part 30, the current measuring part 56*b* detects the current Itr3 (S102).

Next, the computation part 57 calculates the resistance value Rt5 (S103) of the transfer part 30 in a state in which the label 9*a* of the recording medium 9 is present in the transfer part 30 and the resistance value Rt6 of the transfer part 30 when no label 8*a* of the recording medium 8 is present in the transfer part 30 to obtain the shaft voltage Vs0 (S105). The operations of Steps S102 to S105 are the same as those in Steps S51 to S54 (FIG. 15) of the aforementioned first embodiment. Further, in Steps S104 and S105, the computation part 57 performs calculations using the label width W (0) as shown in FIG. 19. That is, since the current Itr 3 is a current value when the vicinity of the side H1 of the label 8*a* is in the transfer part 30, the computation part 57 performs the calculation using the label width W (0) in the vicinity of the side H1.

Next, the measurement position management part 67 sets the variable m to 0 (m=0) (S106). Then, the computation part 57 calculates the transfer current Itr (m) (S107) and calculates the transfer voltage Vtr (m) to be generated by the voltage generation part 56*a* (S108). The operations of Steps S107 and S108 are the same as those in Steps S55 and S56 (FIG. 15) of the aforementioned first embodiment. Further, in Steps S107 and S108, the calculations are performed using the label width W (m). Here, when m is 0, the label width is W(0).

Next, the control part 69 controls the motor drive part 54 to carry the recording medium 9 along the carrying path 20 for the predetermined distance ΔM (for example, 10 mm) only (S109). Next, the label detection part 50 confirms whether or not the label 8*a* has passed the transfer part 30 (S110). When the label 8*a* has not passed the transfer part 30 ("N" in S110), the measurement position management part 67 increments the variable m (S111) and returns to Step S107. Then, Steps S107 to S111 are repeated until the label 8*a* passes the transfer part 30.

In Step S110, when the label 8*a* has passed the transfer part 30 ("Y" in S110), the control part 69 confirms whether or not printing is completed (S112). When printing continuously on the label 8*a* ("N" in S112), it returns to Step S101 and the process is performed on the next label 8*a*. Further, when the printing is completed ("Y" in S112), the flow is completed.

In this way, the image forming apparatus 2 is configured to obtain the label width W (m) at predetermined intervals in the label 8*a* and calculate the transfer voltage Vtr (m)

based on the label width W (m) at each position. With this, even when forming an image on a label 8*a* in which the label width W (m) is not constant, the current density of the current flowing through the recording medium 9 can be brought closer to the medium current density Jp and the potential difference between the voltage of the surface and the voltage of the back surface of the recording medium 9 can be brought closer to the medium voltage Vp. As a result, excellent transfer characteristics can be obtained and the image quality can be improved in the image forming apparatus 2.

Further, since the image forming apparatus 2 is configured to calculate the label width W (m) based on the current Itr2 (*m*), there is no need to equip a sensor exclusively for detecting the label width W (m), and therefore the configuration can be simple.

As described above, since this embodiment is configured to obtain the label width of the label at predetermined intervals to calculate the transfer voltage based on the label width at each position, the image quality can be improved even when forming an image on a label in which the label width is not constant.

Modified Embodiment 2-1

In the aforementioned embodiment, the labels 8*a* has a trapezoidal shape, but not limited to that, and the labels can be of any shape, such as, e.g., a circular shape, an elliptical shape, and a star shape.

Modified Embodiment 2-2

In the aforementioned embodiment, the label width W (m) is calculated using the first label 8*a* among the labels 8*a* arranged side by side and the transfer voltage Vtr (m) is calculated using the second label 8*a* or later, but not limited to that. For example, the label width W (m) as well as the transfer voltage Vtr (m) may be calculated using each of the labels 8*a*.

Modified Embodiment 2-3

In the aforementioned embodiment, the predetermined distance ΔM is set to 10 mm, for example, but not limited to that, and may be shorter than 10 mm or longer than 10 mm, for example. The predetermined distance ΔM, for example, is preferably set according to the size and the shape of the label 8*a*.

Modified Embodiment 2-4

In the aforementioned embodiment, the label width W (m) is obtained per a predetermined interval, but not limited to that, and the intervals for obtaining the label width W (m) may change.

Modified Embodiment 2-5

Each of the modified embodiments may be applied to the image forming apparatus 2 according to the aforementioned first embodiment.

The present invention was explained above with reference to some embodiments and modified embodiments, but the present invention is not limited to these embodiments, etc., and various modifications are possible.

For example, in the aforementioned embodiments, etc., printing is performed on a rolled sheet, but not limited to that, and printing may be performed on any medium as long as it is a long medium. Specifically, for example, a so-called continuous sheet provided with perforations per predetermined length may be used.

Further, for example, in the aforementioned embodiments, the present invention is applied to a color printer, but not limited to that, and for example, it may alternatively be applied to a monochromatic printer.

Furthermore, for example, in the aforementioned embodiments, the present invention is applied to a printer, but not limited to that. Alternatively, for example, the present invention may be applied to a multifunction peripheral apparatus (Multi Function Peripheral) having functions of a printer, a FAX, a scanner, etc.

What is claimed is:

1. An image forming apparatus, comprising:

an image forming part having a transfer part including a transfer member, and a rotation member arranged so as to face the transfer member, and the transfer part being configured to transfer a developer with a transfer voltage to a recording medium of which a front surface is composed with a transfer region and a non-transfer region arranged between the transfer member and the rotation member, in the transfer target region where the developer is to be disposed and in the non-transfer region where the developer is not to be disposed;

a measuring part that measures a first electric resistance value and a second electric resistance value, the first electric resistance value being defined as a resistance value between the transfer member and the rotation member in a state in which the transfer region of the recording medium is not present between the transfer member and the rotation member, and the second electric resistance value being defined as another resistance value between the transfer member and the rotation member in another state in which the transfer region of the recording medium is present between the transfer member and the rotation member; and a control part that determines the transfer voltage value in the transfer part based on the first electric resistance value and the second electric resistance value, the measuring part measures the first electric resistance value before the transfer part starts transferring the developer to the recording medium, the measuring part further measures a third electric resistance value that is defined as another resistance value between the transfer member and the rotation member in another state in which the transfer region of the recording medium is present between the transfer member and the rotation member, the second electric resistance value is measured after the third electric resistance value is measured, and the control part takes the third electric resistance value into account to determine the transfer voltage value.

2. The image forming apparatus according to claim 1, wherein the transfer part sequentially transfers the developer in a carrying direction along which the recording medium is carried, and the measuring part measures the second electric resistance value after the transfer part transfers the developer to the recording medium for a predetermined length in the carrying direction.

3. The image forming apparatus according to claim 1, further comprising:

a temperature sensor that is disposed in the image forming apparatus and detects a temperature of the transfer part, wherein the measuring part measures the second electric resistance value when the temperature of the transfer part is equal to or higher than a predetermined temperature.

4. The image forming apparatus according to claim 1, wherein the measuring part measures the second electric resistance value when the transfer region of the recording medium is present between the transfer member and the rotation member and when the transfer part is not transferring the developer to the transfer region of the recording medium.

5. The image forming apparatus according to claim 1, wherein the control part calculates a medium resistance value with respect to the transfer region of the recording medium based on the first electric resistance value and the third electric resistance value, and the control part determines the transfer voltage value based on the medium resistance value and the second electric resistance value.

6. The image forming apparatus according to claim 1, further comprising:

an environment detection part that detects one or both of an environmental temperature and an environmental humidity, wherein the control part takes a detection result of the environment detection part into account to determines the transfer voltage value.

7. The image forming apparatus according to claim 6, wherein, based on the detection result of the environment detection part, the control part obtains a first target value of a current density of a current to be flown through the recording medium, and a second target value of a potential difference between a voltage on the front surface of the recording medium and a voltage of a back surface of the recording medium, and the control part determines the transfer voltage value based on the first target value and the second target value.

8. The image forming apparatus according to claim 1, wherein the measuring part measures the second electric resistance value multiple times across the transfer region of the recording medium.

9. The image forming apparatus according to claim 8, wherein after measuring the second electric resistance value, the measuring part measures the second electric resistance value again when the transfer region of the recording medium has passed through between the transfer member and the rotation member for a predetermined length.

10. The image forming apparatus according to claim 9, wherein the measuring part measures the second electric resistance value every time when the transfer region of the recording medium passes through between the transfer member and the rotation member for a predetermined length.

11. The image forming apparatus according to claim 8, wherein the control part obtains a width of the transfer region based on the second electric resistance value and determines the transfer voltage value based on the width of the transfer region.

12. The image forming apparatus according to claim 1, wherein the transfer body rotates in a predetermined rotational direction, and the second electric resistance value includes an electric resistance value between the transfer member and the rotation member, being determined when a rotation angle of the transfer member is a first angle, and another electric resistance value between the transfer member and the rotation member, being determined when a rotation angle of the transfer member is a second angle that is different from the first angle.

13. The image forming apparatus according to claim 1, wherein the recording medium is a rolled sheet that is configured with a continuous mount and labels attached on the mount with an interval to each other, and the transfer region corresponds to each of the labels.

14. The image forming apparatus according to claim 1, wherein the image forming part further includes a transfer belt on which the developer is carried, and the transfer member transfers the developer on the transfer belt to the recording medium.

15. The image forming apparatus according to claim 1, wherein the rotation member includes a photosensitive member on which a latent image is formed, and the transfer member transfers a developer image, which is formed with the developer, on the photosensitive member to the recording medium.

16. An image forming method performed with a transfer part, comprising:

measuring, in the transfer part having a transfer member and a rotation member arranged so as to face the transfer member and configured to transfer a developer with a transfer voltage to a recording medium of which a surface is composed with a transfer region and a non-transfer region arranged between the transfer member and the rotation member, a first electric resistance value between the transfer member and the rotation member in a state in which the transfer region of the recording medium is not present between the transfer member and the rotation member;

measuring a second electric resistance value between the transfer member and the rotation member in a state in which the transfer region of the recording medium is present between the transfer member and the rotation member;

measuring a third electric resistance value that is defined as another resistance value between the transfer member and the rotation member in another state in which the transfer region of the recording medium is present between the transfer member and the rotation member, the third electric resistance value being measured before the second electric resistance value is measured, and determining the transfer voltage value in the transfer part based on the first electric resistance value, the second electric resistance value and the third electric resistance value.

* * * * *